US011266247B2

(12) United States Patent
Chen et al.

(10) Patent No.: US 11,266,247 B2
(45) Date of Patent: Mar. 8, 2022

(54) EASILY ASSEMBLED CHAIR ARMREST

(71) Applicant: ATEC INTERNATIONAL TEAM CO., LTD., Luzhu Township, Taoyuan County (TW)

(72) Inventors: Te-Chun Chen, Luzhu Township, Taoyuan County (TW); Fu-Ming Chen, Luzhu Township, Taoyuan County (TW)

(73) Assignee: ATEC INTERNATIONAL TEAM CO., LTD., Luzhu Township (TW)

( * ) Notice: Subject to any disclaimer, the term of this patent is extended or adjusted under 35 U.S.C. 154(b) by 0 days.

(21) Appl. No.: 16/908,330

(22) Filed: Jun. 22, 2020

(65) Prior Publication Data

US 2021/0259427 A1 Aug. 26, 2021

(30) Foreign Application Priority Data

Feb. 24, 2020 (TW) ..... 109105883

(51) Int. Cl.
*A47C 7/54* (2006.01)

(52) U.S. Cl.
CPC ..... *A47C 7/541* (2018.08)

(58) Field of Classification Search
CPC ..... A47C 1/03; A47C 1/0307; A47C 1/0308
USPC ..... 297/411.36, 411.37
See application file for complete search history.

(56) References Cited

U.S. PATENT DOCUMENTS

| | | | | |
|---|---|---|---|---|
| 6,948,774 | B2 * | 9/2005 | Maier | A47C 1/03 297/411.31 |
| 7,360,839 | B1 * | 4/2008 | Chen | A47C 1/0307 297/411.2 |
| 7,559,609 | B2 * | 7/2009 | Tsai | A47C 1/0307 297/411.35 |
| 7,837,269 | B2 * | 11/2010 | Bock | A47C 1/03 297/411.35 |
| 10,537,175 | B2 * | 1/2020 | Chen | A47C 1/03 |
| 2011/0248543 | A1 * | 10/2011 | Hitchcock | A47C 1/0308 297/411.36 |
| 2012/0205958 | A1 * | 8/2012 | Colasanti | A47C 1/03 297/411.36 |

* cited by examiner

*Primary Examiner* — Sarah B McPartlin
(74) *Attorney, Agent, or Firm* — Muncy, Geissler, Olds & Lowe, P.C.

(57) ABSTRACT

An easily assembled chair armrest composed an armrest support, a connecting portion, and an armrest revealed. The connecting portion with a lock head is selectively disposed on the armrest or the armrest support while a locking hole is arranged at the armrest or the armrest support without the connecting portion. A locking slot communicates with the inner side of the locking hole. The armrest and the armrest support are in a first assembled state when the lock head is mounted into the locking slot through the lock hole. Then the lock head is horizontally rotated a staggered angle within the locking slot so that a lengthwise central axis of the armrest and a lengthwise central axis of the armrest support are coupled. Now the armrest and the armrest support are fastened into one part to be in a second assembled state. Thereby both structural strength and tightness are improved.

24 Claims, 34 Drawing Sheets

EASILY ASSEMBLED CHAIR ARMREST

BACKGROUND OF THE INVENTION

Technical Field

The present invention relates to a chair armrest, especially to a chair armrest which includes an armrest support and an armrest easy to be separated from each other or assembled into one part.

Description of Related Art

Generally, a functional armrest includes two main components—an armrest support and an armrest. The armrest support which is a L-shaped part composed of a vertical rod and a horizontal rod connected to the vertical rod is fastened and fixed on the left side and the right side (in users' view) of a chair seat. Then the armrest is assembled and fixed on the top of the vertical rod of the armrest support. However, the volume of the armrest is too large and this is not ideal for package and/or transportation once the armrest and the armrest support are assembled into one part in advance on the manufacturing end and then delivered to the client end (the sale end or the consumer end). Thus the cost at the manufacturing end is increased. On the other hand, the assembly process can be carried out at the client end. According to the structure of the armrest and the armrest support available now, they are not easily assembled and extra fastening parts (such as screw) or tools (such as screwdriver) are required. Once the design of the assembly at the manufacturing end is not good enough, the structure strength and/or tightness of the armrest may be reduced while the armrest is assembled at the client end. This even causes risk while the armrest being used at the consumer end. Moreover, the conventional functional armrest already provide multiple adjustment functions such as adjustment in the lengthwise direction, rotational adjustment or height adjustment which make the armrest more convenient and comfortable while in use. At the manufacturing end, not only easy assembly should be considered, the adjustment functions after the assembly also should be considered at the same time. Otherwise the product is uncompetitive in the market.

SUMMARY OF THE INVENTION

Therefore it is a primary object of the present invention to provide an easily assembled chair armrest with improved structural strength and tightness after assembly after assembly.

In order to achieve the above object, an easily assembled chair armrest according to the present invention includes an armrest support, a connecting portion with a lock head and an armrest. The connecting portion can be either disposed on the armrest or the armrest support while the armrest or the armrest support without the connecting portion is provided with a locking hole and a locking slot, both corresponding to the lock head. The locking slot is communicating with and arranged at the inner side of the locking hole. While assembling the armrest and the armrest support, the lock head is vertically aligned with and mounted into the lock hole and then is mounted into the locking slot. Thereby the armrest and the armrest support are in a first assembled state. Then the lock head is horizontally rotated a staggered angle within the locking slot so that the lengthwise central axis of the armrest and the lengthwise central axis of the armrest support are coupled with each other. Now the armrest and the armrest support are assembled with each other and fastened into one part to be in a second assembled state.

In order to achieve the above object, an easily assembled chair armrest according to the present invention includes an armrest support, a connecting portion and an armrest. The armrest support includes a top surface while a mounting base is arranged at the top surface of the armrest support and having a lengthwise central axis. The connecting portion is integrally formed on and projecting from the mounting base of the armrest support. The connecting portion consists of a lock head with a certain thickness in the vertical direction and a lock neck disposed under and connected to the lock head. The lock neck includes a vertical central axis. The armrest is composed of an armrest pad and an armrest body which is connected to and enclosed in the armrest pad. The armrest body has a lengthwise central axis. A locking hole is disposed on a bottom surface of the armrest body and a vertical locking slot with a certain depth is communicating with and arranged at the inner side of the locking hole. The shape and the area of the horizontal section of the locking hole are a bit larger than those of the lock head of the connecting portion so that the lock head can be vertically mounted into the locking hole and located in the vertical locking slot. The shape and the area of the horizontal section of the locking slot are larger than and including the shape and the area of the horizontal section of the lock head of the connecting portion so that the locking slot includes at least one more travel area than the lock head. The lock head can be rotated horizontally along the respective travel area and then stopped and positioned at a stopping position of the travel area after being vertically mounted into the locking slot. The lock head can be vertically mounted into the locking slot through the lock hole when the locking hole of the armrest body is vertically aligned with the lock head of the connecting portion. Now the armrest body and the lock head are in a first assembled state. There is a staggered angle formed between the lengthwise central axis of the armrest body and the lengthwise central axis of the mounting base while the armrest body and the lock head are in the first assembled state. When the armrest body and the lock head are in the first assembled state, the lock head can be rotated horizontally around the vertical central axis of the lock neck within the locking slot. The lock head is stopped and positioned at the stopping position of the travel area when the lock head is rotated the staggered angle within the locking slot and the lengthwise central axis of the armrest body and the lengthwise central axis of the mounting base are coupled with each other. At the moment, the armrest body and the lock head are in a second assembled state. And the armrest and the armrest support are assembled with each other and fastened into one part.

In order to achieve the above object, an easily assembled chair armrest according to the present invention includes an armrest support, a connecting portion and an armrest. In this easily assembled chair armrest, the connecting portion (with the lock head) is selectively disposed on the armrest support while the lock hole and the locking slot are arranged at the armrest. The difference between this easily assembled chair armrest and the above one is in that the connecting portion of this easily assembled chair armrest is detachably disposed on and projecting from the mounting base of the armrest support while the connecting portion of the above one is integrally formed on and projecting from the mounting base of the armrest support. The rest of the structure of this easily assembled chair armrest is about the same as that of the above one.

In order to achieve the above object, an easily assembled chair armrest according to the present invention includes an armrest support, a connecting portion and an armrest. A mounting base is arranged at the top surface and is provided with a lengthwise central axis. A locking hole is disposed on the top surface of the mounting base and a vertical locking slot having a certain depth is communicating with and arranged at the inner side of the locking hole. The connecting portion consists of a lock head with a certain thickness in the vertical direction and a lock neck which is having a vertical central axis, disposed under and connected to the lock head. The armrest is composed of an armrest pad and an armrest body which is connected to the armrest pad, enclosed in the armrest pad, and having a lengthwise central axis. The connecting portion is integrally formed on and projecting from the bottom surface of the armrest body of the armrest. The shape and the area of a horizontal section of the locking hole of the armrest support are a bit larger than the shape and the area of a horizontal section of the lock head of the connecting portion so that the lock head can be vertically mounted into the locking hole and located in the locking slot. The shape and the area of a horizontal section of the locking slot of the armrest support are larger than and including the shape and the area of the horizontal section of the lock head of the connecting portion so that the locking slot includes at least one more travel area than the lock head. Thus the lock head is able to be rotated horizontally along the travel area and then stopped and positioned at a stopping position of the travel area after being vertically mounted into the locking slot. The lock head is vertically mounted into the locking slot through the lock hole when the lock head of the connecting portion and the lock hole of the armrest support are vertically aligned with each other. At the moment, the lock head and the armrest support are in a first assembled state. There is a staggered angle formed between the lengthwise central axis of the mounting base and the lengthwise central axis of the armrest body when the lock head and the armrest support are in the first assembled state. The lock head is rotated horizontally around the vertical central axis of the lock neck within the locking slot when the lock head and the armrest support are in the first assembled state. The lock head is stopped and positioned at the stopping position of the travel area when the lock head is rotated the staggered angle within the locking slot and the lengthwise central axis of the mounting base and the lengthwise central axis of the armrest body are coupled with each other. Now the lock head and the armrest support are in a second assembled state while the armrest and the armrest support are assembled and fastened into one part.

In order to achieve the above object, an easily assembled chair armrest according to the present invention includes an armrest support, a connecting portion and an armrest. In this easily assembled chair armrest, the connecting portion (with the lock head) is selectively disposed on the armrest while the lock hole and the locking slot are arranged at the armrest support. The difference between this easily assembled chair armrest and the above one is in that the connecting portion is detachably disposed on and projecting from the bottom surface of the armrest support of the armrest in this easily assembled chair armrest while the connecting portion of the above easily assembled chair armrest is integrally formed on and projecting from the bottom surface of the armrest body of the armrest. The rest of the structure of this easily assembled chair armrest is about the same as that of the above one.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PROFFERED EMBODIMENTS

Figure 1:
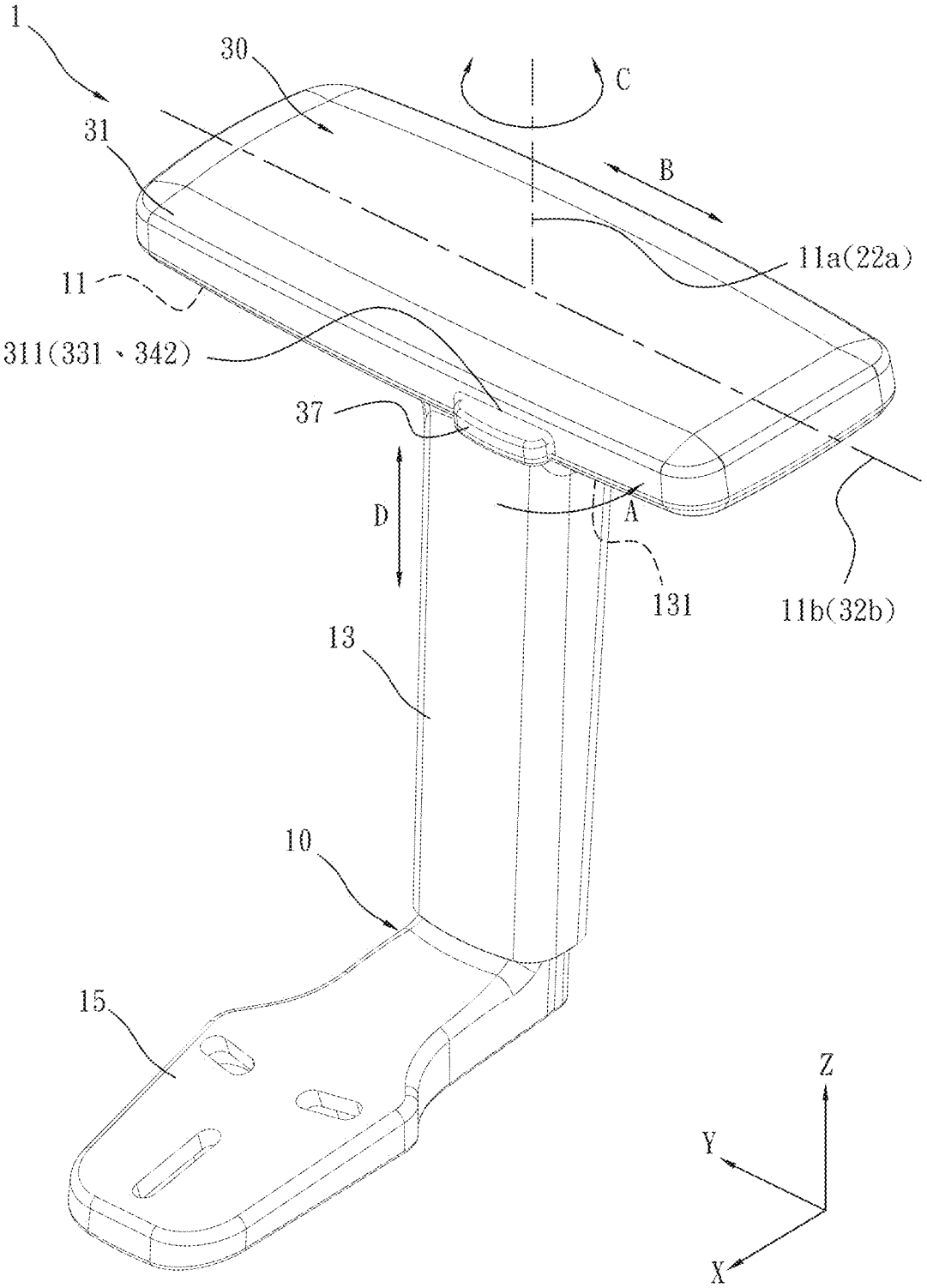
FIG. 1 is a perspective view of an embodiment according to the present invention.

With reference to figures, the structure and technical features of the present invention are described in details in the following embodiments. The figures are used to show structure and related functions of the present invention. The respective components in the figures are not drawn to scale, not to limit the scope of the present invention. Moreover, a plurality of embodiments (including the first, the second, the third and the fourth embodiments) described as follows is not intended to limit the invention to these particular embodiments. Moreover, it should be understood that components not specifically shown in figures or described can exist in various forms well known by those skilled in the art. The embodiments described as the following may use the same reference numerals and/or words repeatedly and these repeats are for purposes of simplification and clarification, not intended to limit the embodiments described and/or the relation of the structure.

Refer to FIG. 1-3 and FIG. 21, an easily assembled chair armrest 1 according to the present invention includes an armrest support 10, a connecting portion 20 and an armrest 30. As shown in FIG. 1, a seat connecting portion 15 for connecting the chair armrest 1 to a seat of a chair is disposed on the bottom of the armrest support 10. Generally, the armrest support 10 is fastened and fixed on the right side and the left side of the seat (based on user's position). The lengthwise direction mentioned in the following description is viewed based on user's position.

Figure 2:
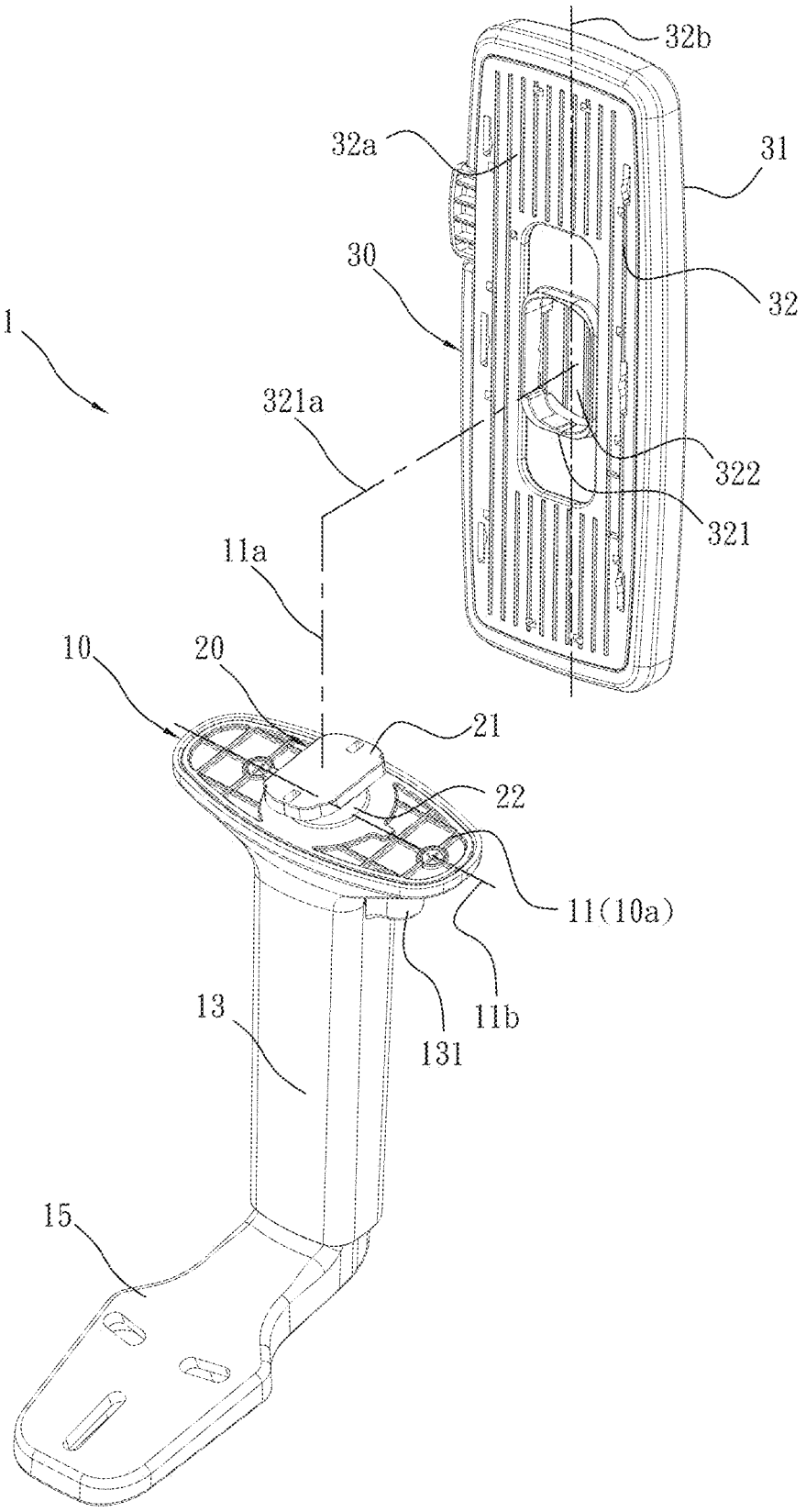
FIG. 2 is a schematic drawing showing an embodiment in which a lock hole of an armrest body is aligned with a lock head of a connecting portion on an armrest support according to the present invention.

Refer to FIG. 2, the armrest support 10 includes a top surface 10*a*. A mounting base 11 is arranged at the top surface 10*a* and having a lengthwise central axis 11*b* in the lengthwise direction (as shown in FIG. 1). The connecting portion 20 is disposed on and projecting from the mounting base 11 of the armrest support 10. The connecting portion 20 consists of a lock head 21 with a certain thickness in the vertical direction and a lock neck 22 disposed under and connected to the lock head 21. The lock neck 22 includes a vertical central axis 22*a* (as shown in FIG. 1). The connecting portion 20 can be arranged at any position of the mounting base 11. For example, the connecting portion 20 can be disposed on the center of the mounting base 11 (as shown in FIG. 2), or beside the center of the mounting base 11 (not shown in figure). The shape of a horizontal section of the lock head 21 can be an ellipse, a rectangle or a triangle.

Figure 16:
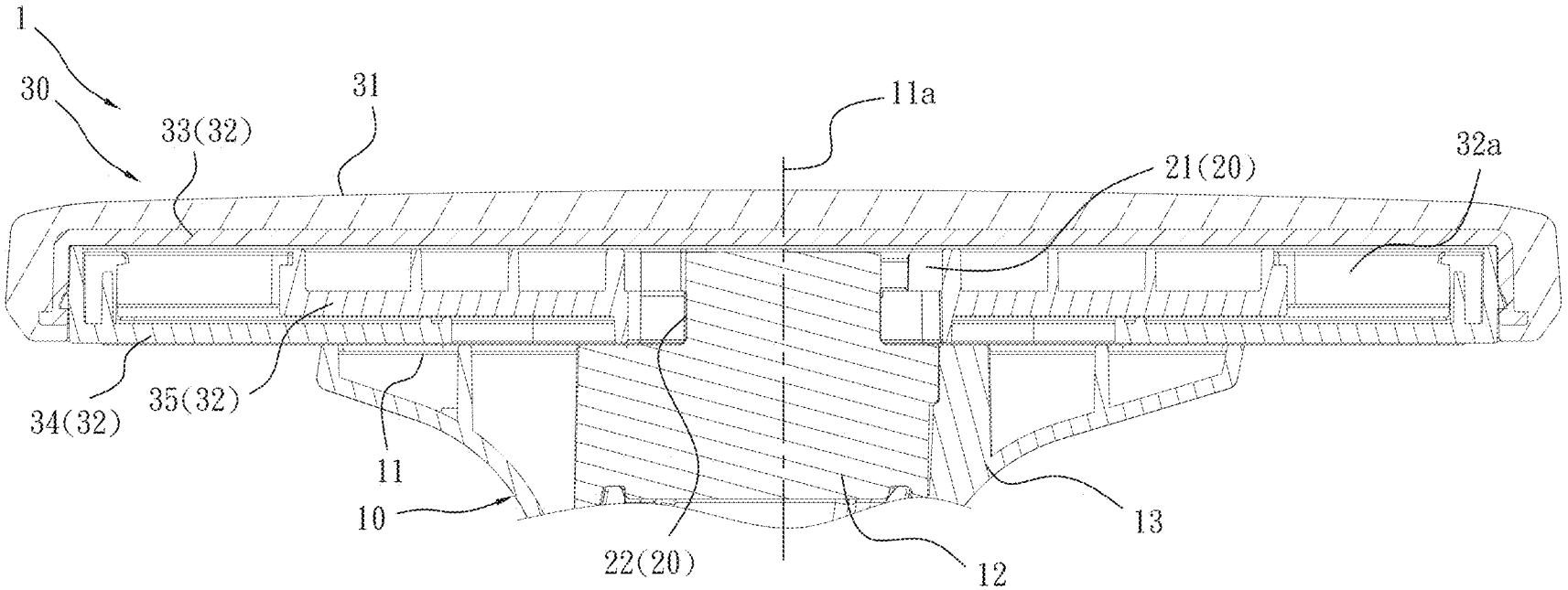
FIG. 16 is a partial sectional view of the embodiment in FIG. 10 in which an armrest support, a connecting portion and an armrest are integrated into one part according to the present invention.
Figure 17:
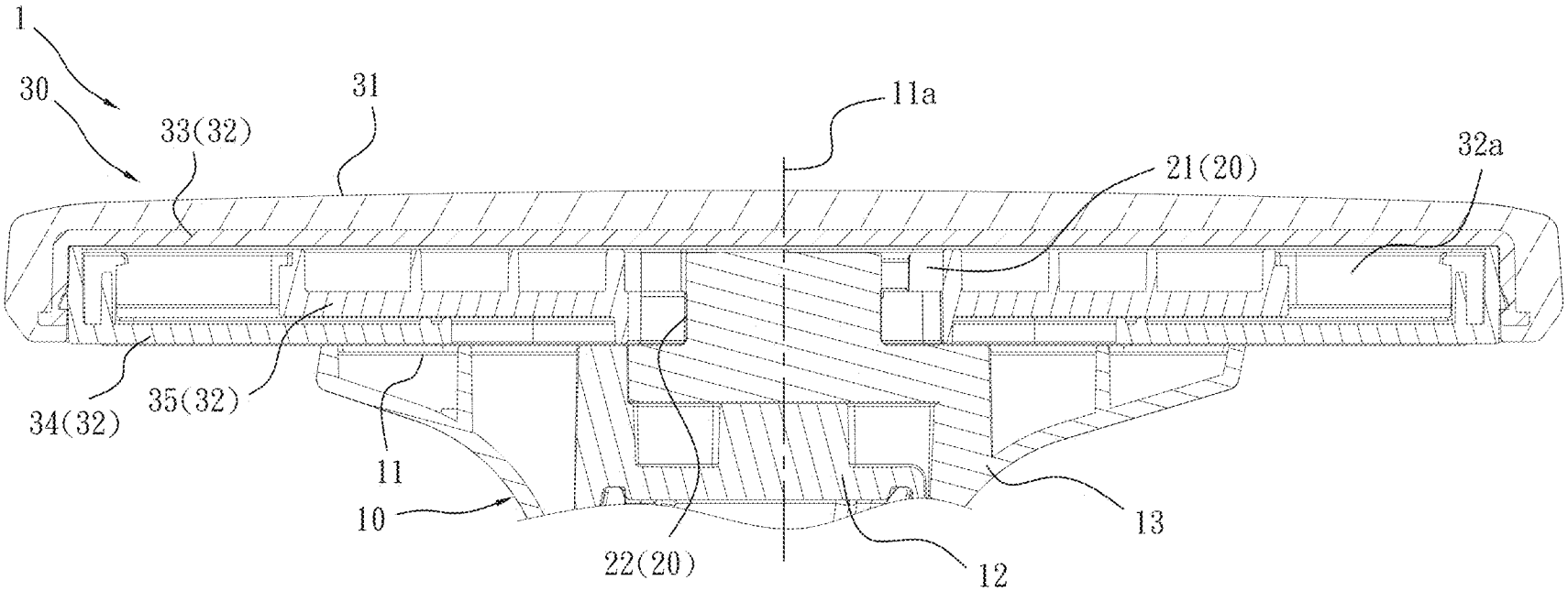
FIG. 17 is a partial sectional view of the embodiment in FIG. 11 in which an armrest support, a connecting portion and an armrest are integrated into one part according to the present invention.
Figure 24:
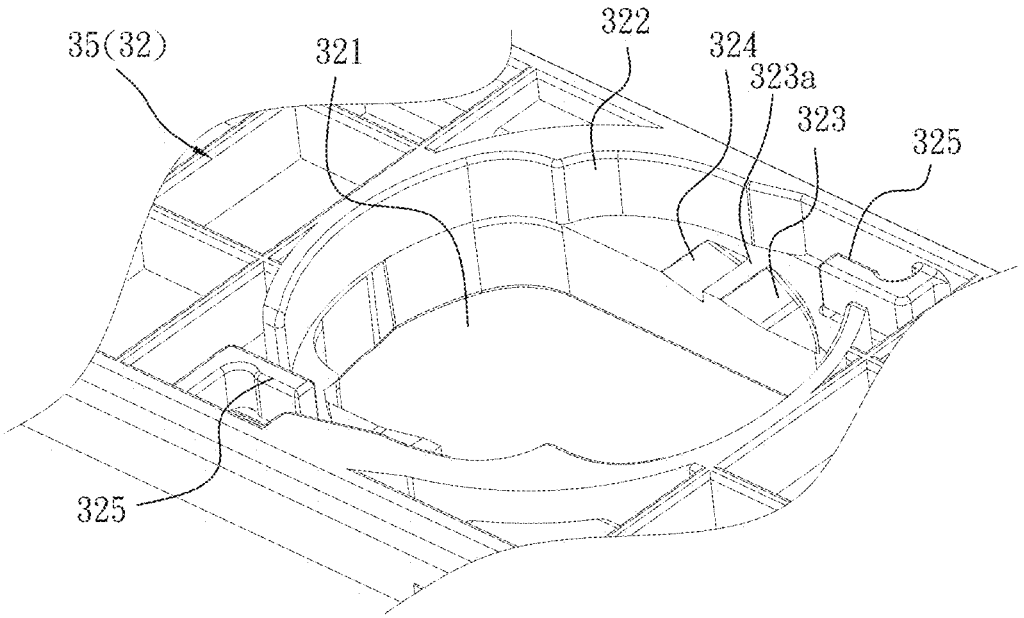
FIG. 24 is a partial enlarged view of a lock hole and a locking slot disposed on a slide plate of an embodiment according to the present invention.
Figure 32:
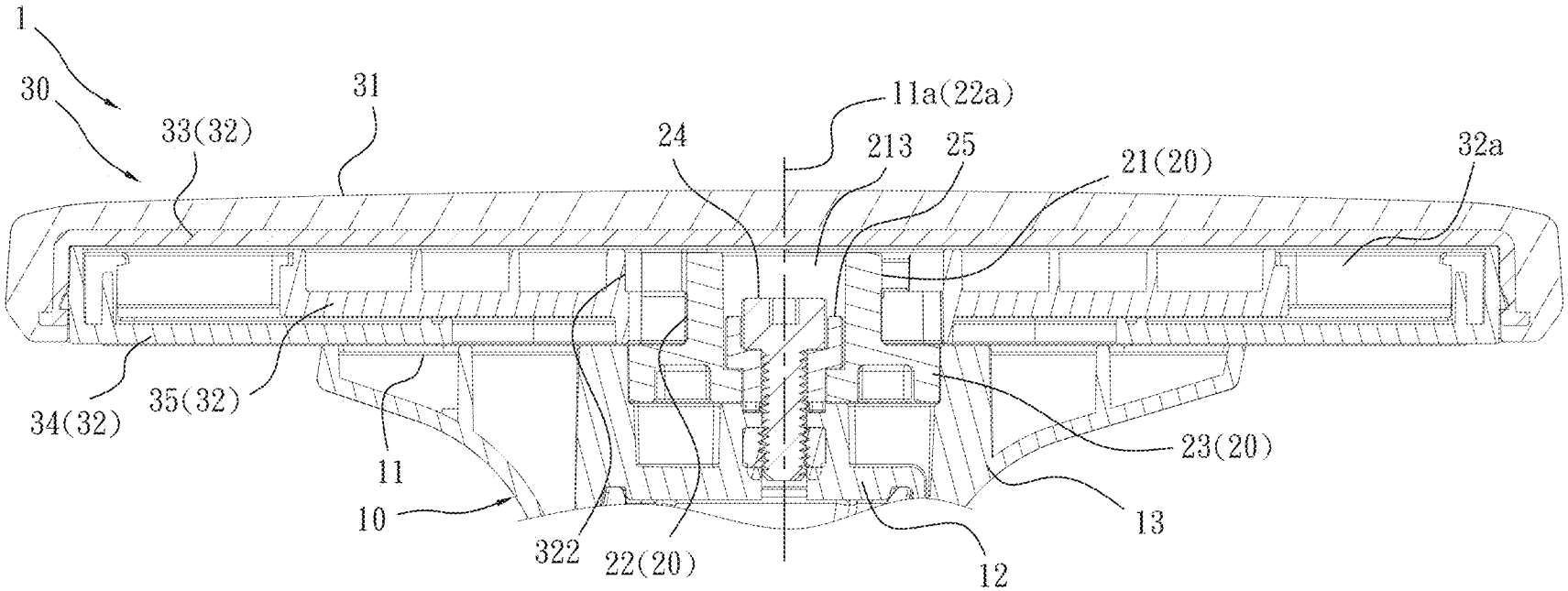
FIG. 32 is a partial sectional view of the embodiment in FIG. 29 according to the present invention.

Refer to FIG. 16, FIG. 17 and FIG. 32, the armrest 30 is composed of an armrest pad 31 and an armrest body 32 which is connected to and enclosed in the armrest pad 31. The armrest body 32 has a lengthwise central axis 32*b* (as shown in FIG. 1). A locking hole 321 is disposed on a bottom surface 32*a* of the armrest body 32 and a vertical locking slot 322 with a certain depth is communicating with and arranged at the inner side of the locking hole 321, as shown in FIG. 2 and FIG. 24.

Figure 13:
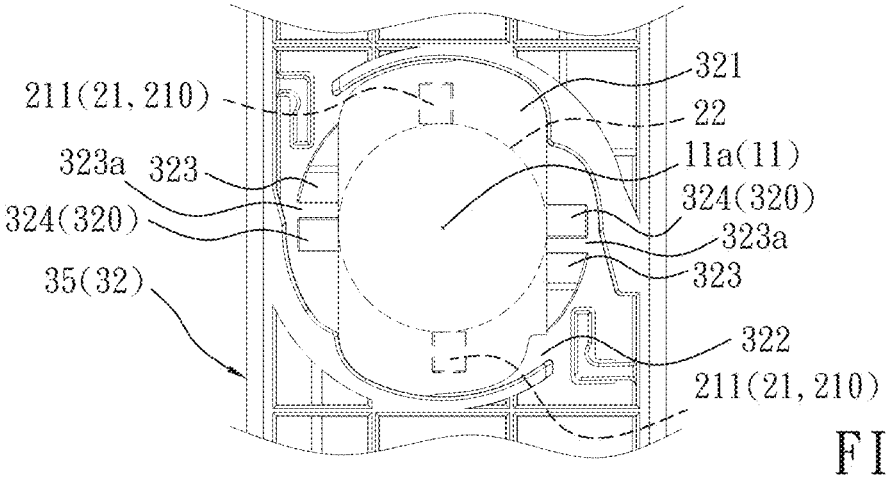
FIG. 13 is a top view of an embodiment in which a locking member and a positioning portion are not locked with each other according to the present invention.
Figure 14:
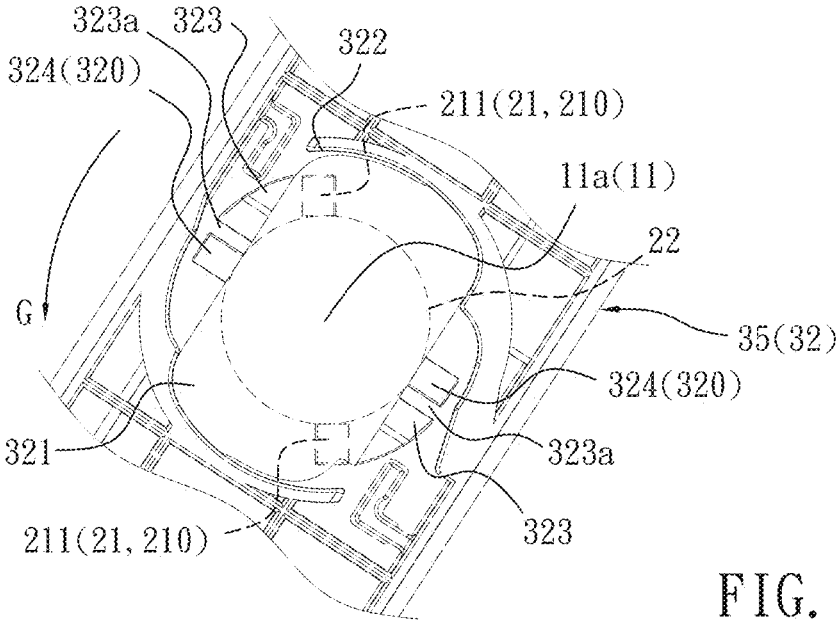
FIG. 14 is a top view of an embodiment in which a positioning portion is rotated along with an armrest body according to the present invention.
Figure 15:
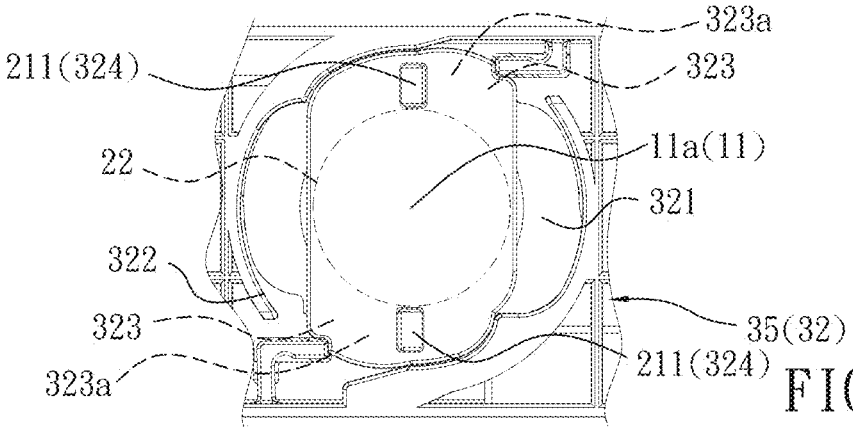
FIG. 15 is a top view of an embodiment in which a locking member and a positioning portion are locked with each other according to the present invention.
Figure 21:
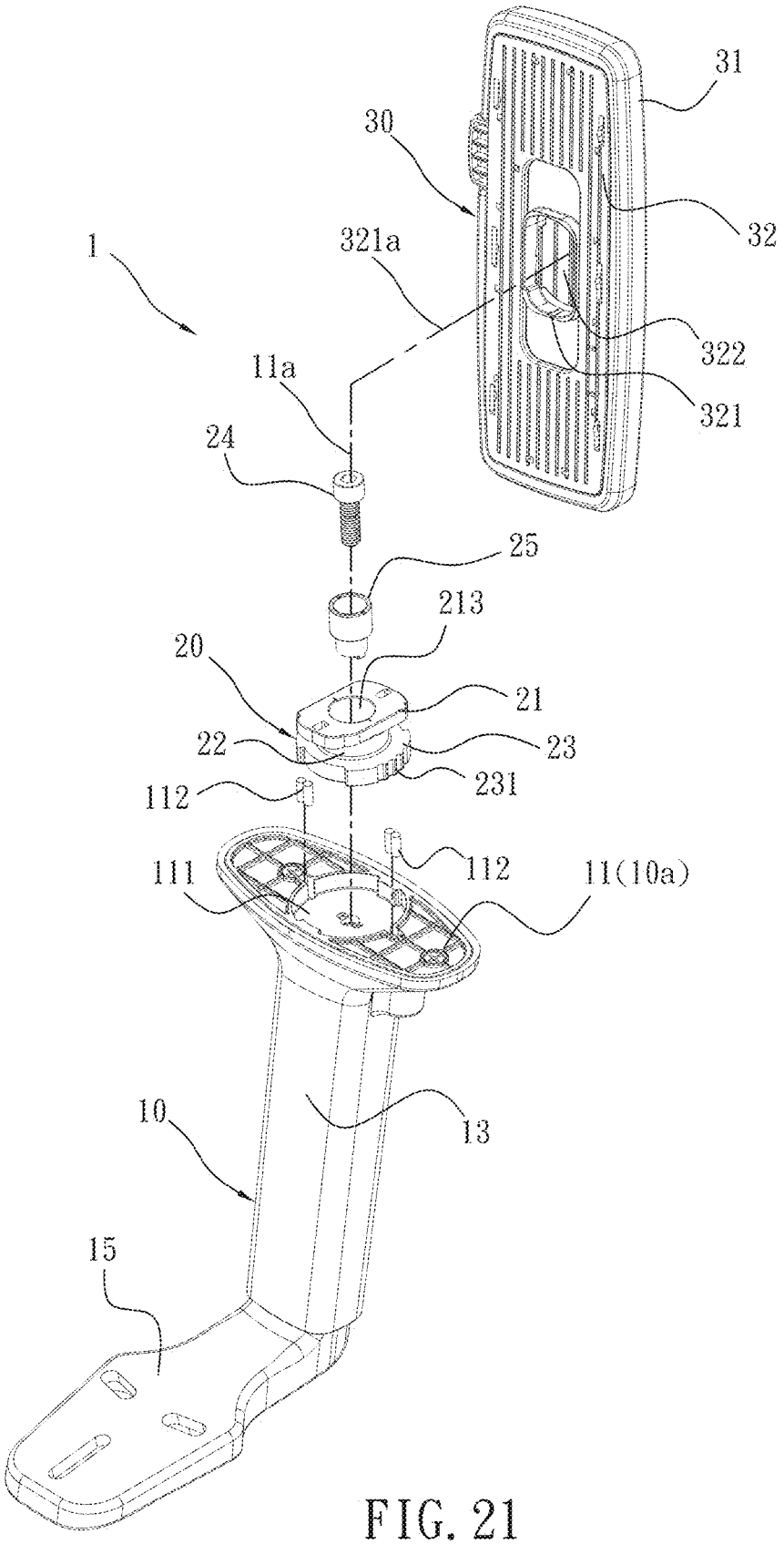
FIG. 21 is an explosive view of an embodiment (the second embodiment) in which a lock hole of an armrest body is aligned with a lock head of a connecting portion of an armrest support (the connecting portion is detachably arranged at the mounting base) according to the present invention.

Refer to FIG. 4-7 and FIG. 25-28, both the shape and the area of the horizontal section of the locking hole 321 are a bit larger than those of the lock head 21 of the connecting portion 20 so that the lock head 21 can be vertically mounted into the locking hole 321 and located in the vertical locking slot 322 (as a vertical central axis 11*a* and a vertical central axis 321*a* shown in FIG. 2 and a vertical central axis 11*a* and a vertical central axis 321*a* shown in FIG. 21). The shape and the area of the horizontal section of the locking slot 322 are larger than and including the shape and the area of the horizontal section of the lock head 21 of the connecting portion 20 so that the locking slot 322 includes at least one more travel area 323 (as shown in FIG. 13-15) than the lock head 21. After being vertically mounted into the locking slot 322, the lock head 21 can be rotated horizontally along the respective travel area 323 and then stopped and positioned at a stopping position 323*a* of the travel area 323, as shown in FIG. 13-15. The horizontal section of the locking hole 321 can be, but not limited to, oblique, rectangular or triangle.

Refer to FIG. 2 and FIG. 21, the lock head 21 can be vertically mounted into the vertical locking slot 322 through the lock hole 321 when the lock head 21 of the connecting portion 20 is vertically aligned with the locking hole 321 of the armrest body 32. Now the armrest body 32 and the lock head 21 are in a first assembled state, as shown in FIG. 3.

While in the first assembled state, the assembly relationship of the lock head 21, the lock neck 22, the locking hole 321 and the locking slot 322 can be: the lock head 21 is just abutting against the wall surface of the locking slot 322 and the lock neck 22 is completely located in the locking hole 321 (not shown in figure), the lock head 21 is just abutting against the wall surface of the locking slot 322 while a part of the lock neck 22 is exposed and located outside the locking hole 321 (not shown in figure), or the depth of the wall surface of the locking slot 322 is larger than the thickness of the lock head 21 while the lock neck 22 is completely located in the locking hole 321 (not shown in figure).

Figure 3:
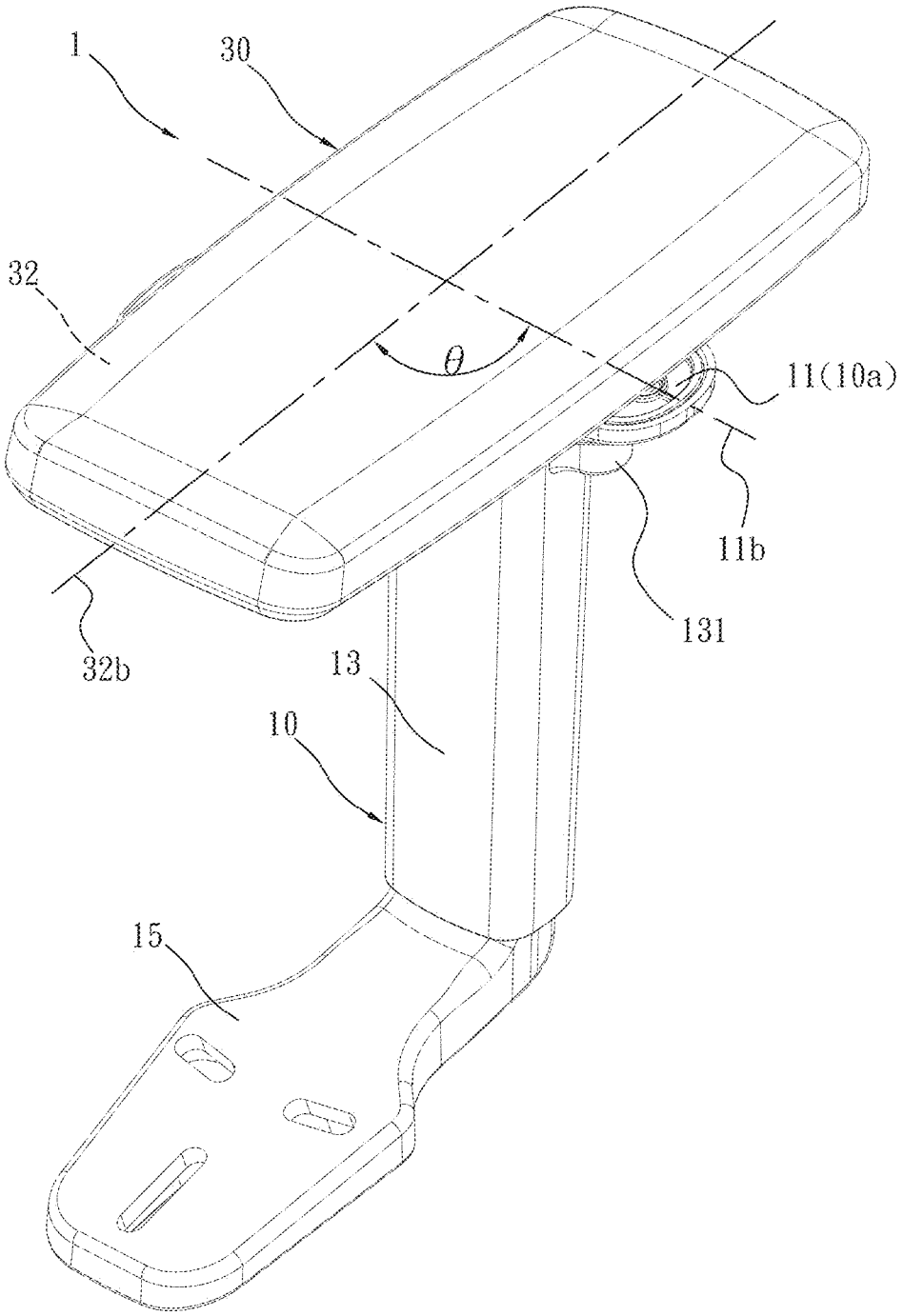
FIG. 3 is a perspective view of an embodiment in which an armrest body (armrest) and a lock head (armrest support) in a first assembled state according to the present invention.
Figure 4:
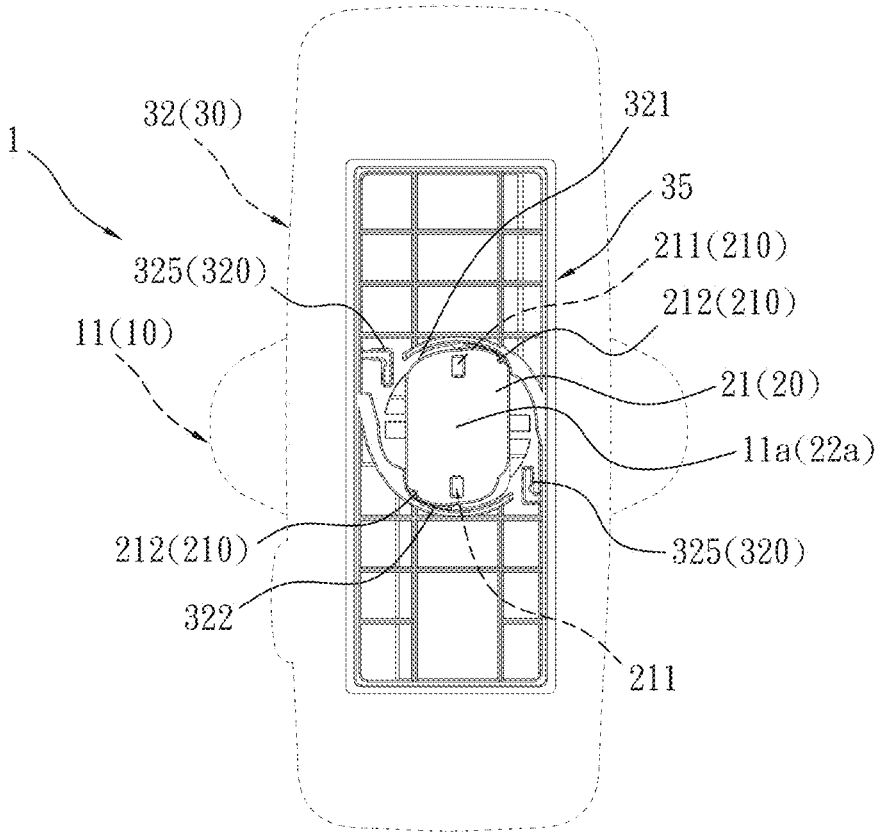
FIG. 4 is a top plan view of the embodiment in FIG. 3 according to the present invention.
Figure 5:
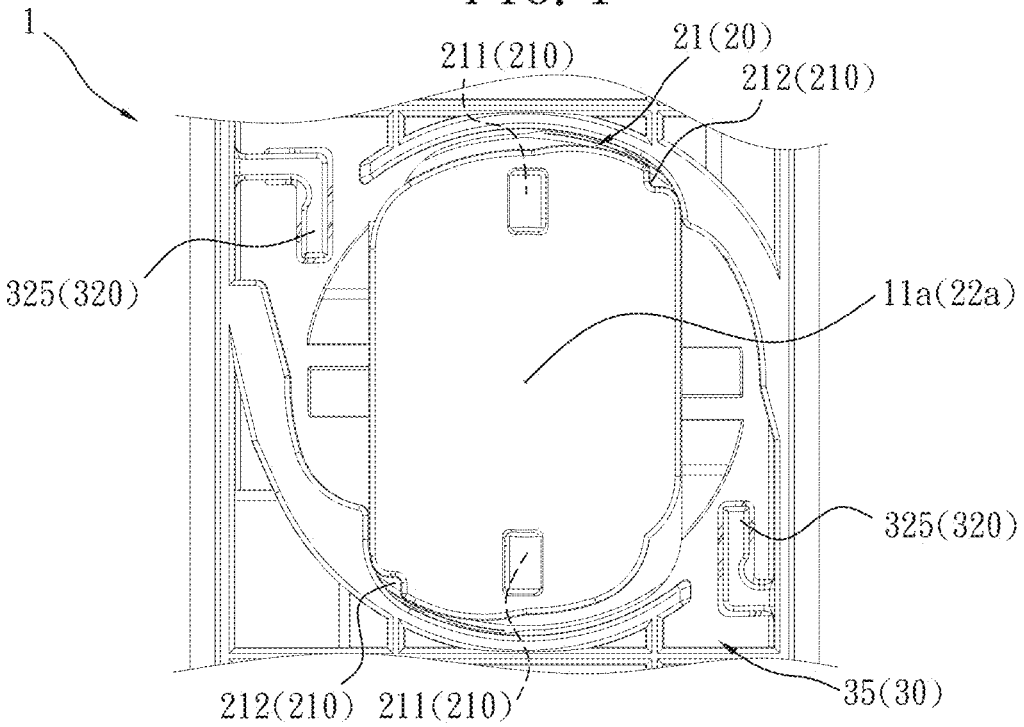
FIG. 5 is a partial enlarged view of the embodiment in FIG. 4 according to the present invention.
Figure 25:
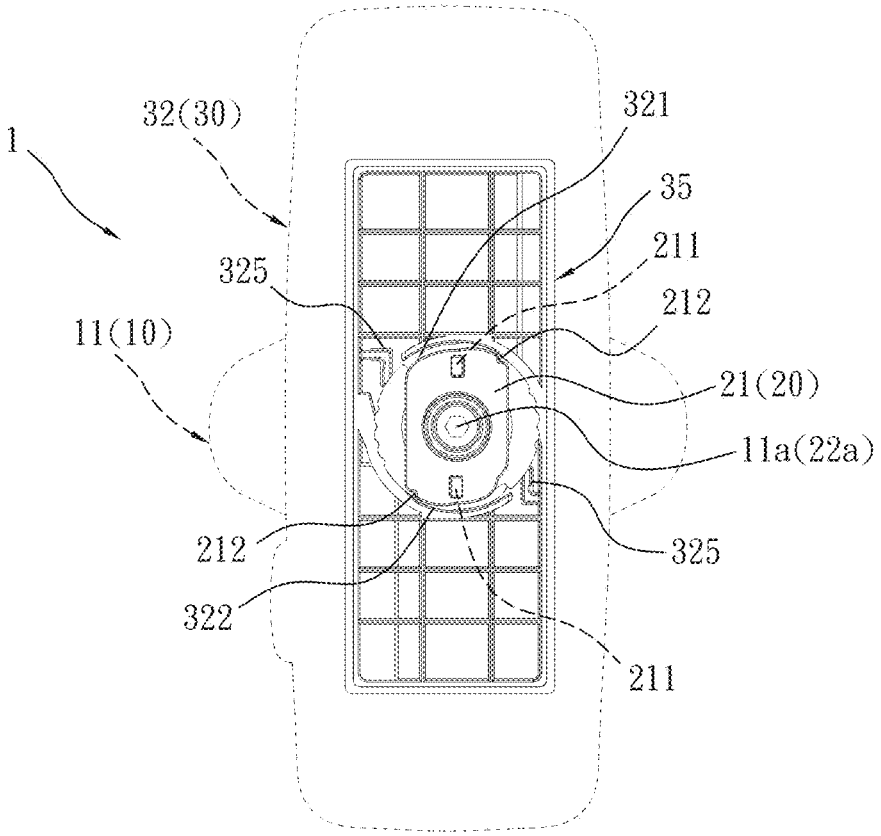
FIG. 25 is a top plan view of an embodiment (the second embodiment) in which an armrest body and a lock head are in a first assembled state (the connecting portion is detachably arranged at the mounting base) according to the present invention.
Figure 26:
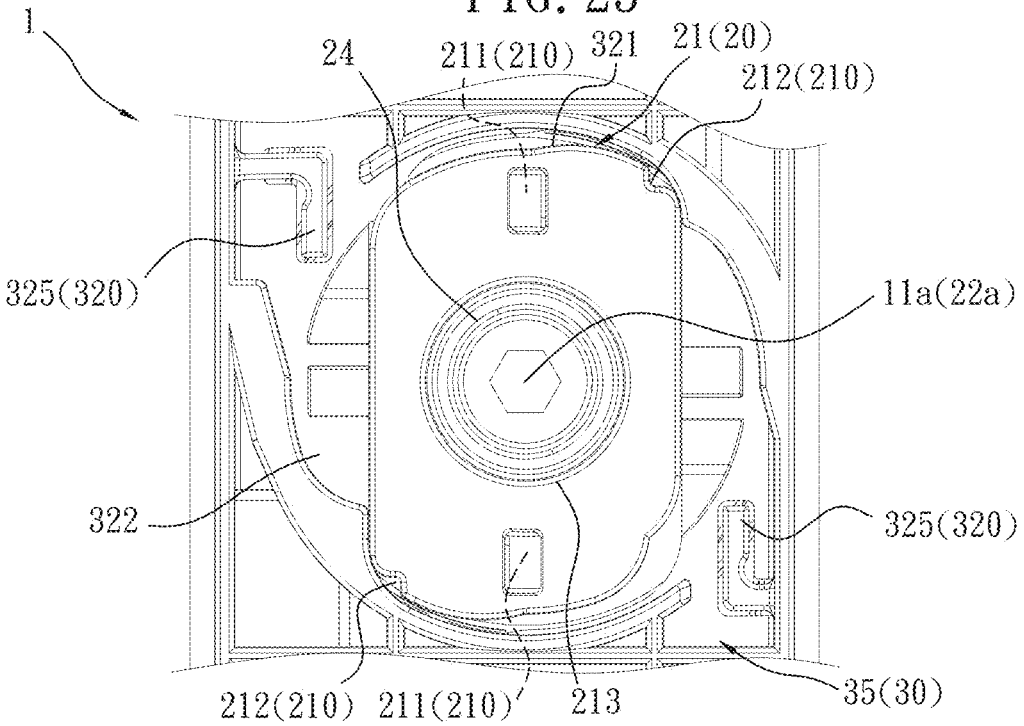
FIG. 26 is a partial enlarged view of the embodiment in FIG. 25 according to the present invention.

As shown in FIG. 3, FIG. 4 and FIG. 25, while the armrest body 32 and the lock head 21 are in the first assembled state, there is a staggered angle θ formed between the lengthwise central axis 32*b* of the armrest body 32 and the lengthwise central axis 11*b* of the mounting base 11. The staggered angle θ can be designed to range from zero to 180°. In this embodiment, the staggered angle θ is 90°.

Figure 6:
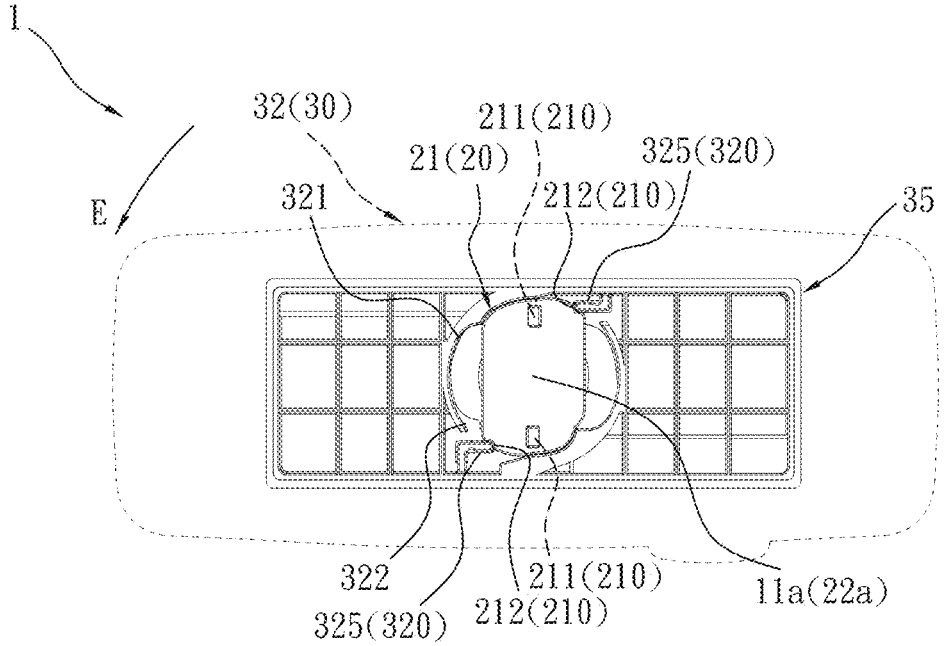
FIG. 6 is a partial enlarged plan view of the embodiment in FIG. 1 according to the present invention.
Figure 7:
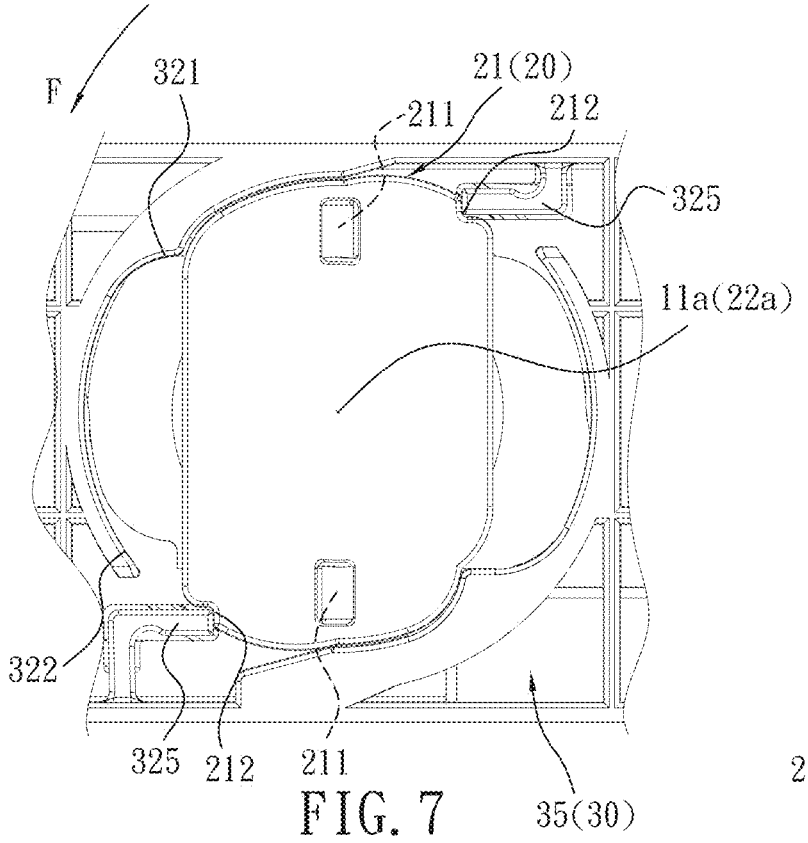
FIG. 7 is a partial enlarged view of the embodiment in FIG. 6 according to the present invention.
Figure 27:
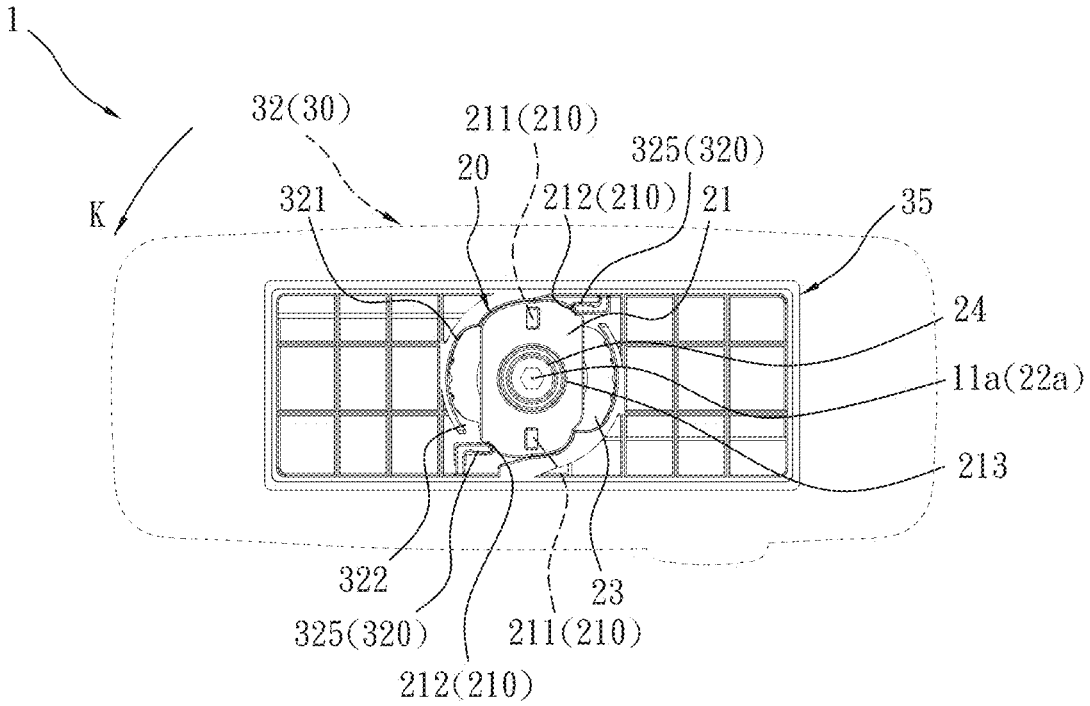
FIG. 27 is a top plan view of an embodiment (the second embodiment) in which an armrest body and a lock head are in a second assembled state (the connecting portion is detachably arranged at the mounting base) according to the present invention.
Figure 28:
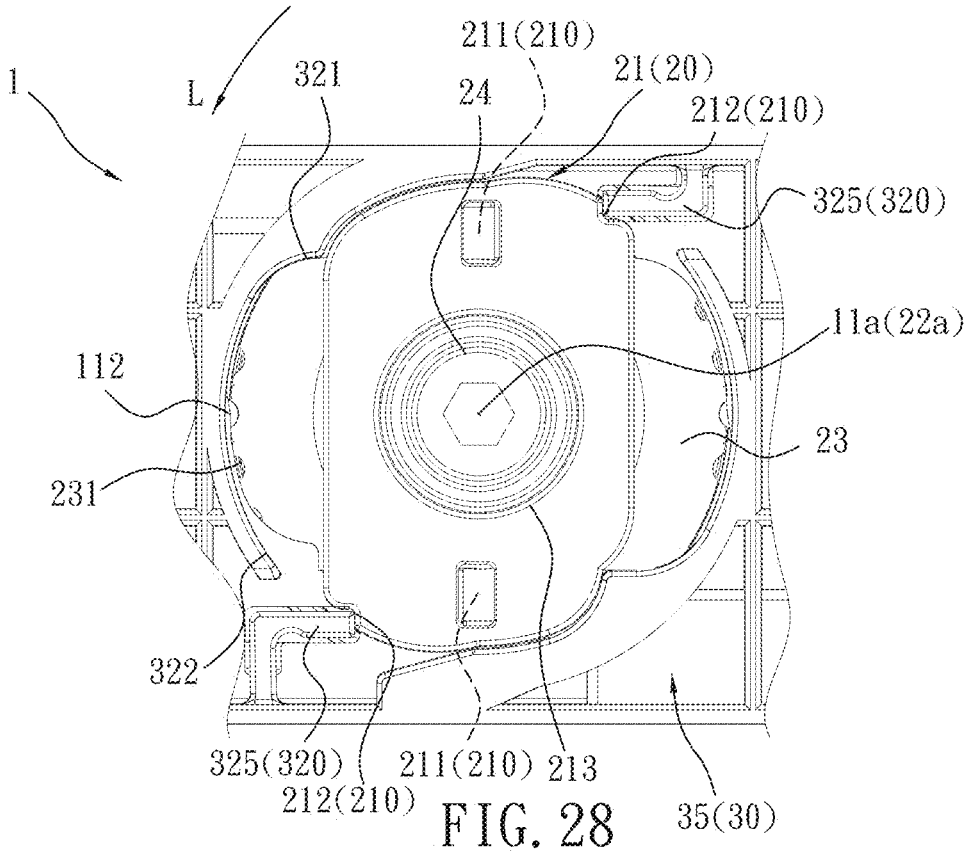
FIG. 28 is a partial enlarged view of the embodiment in FIG. 27 according to the present invention.

When the armrest body 32 and the lock head 21 are in the first assembled state (as shown in FIG. 3, FIG. 4 and FIG. 25), the lock head 21 can be rotated horizontally around the vertical central axis 22*a* (as shown in FIG. 4, FIG. 6, FIG. 25 and FIG. 27) of the lock neck 22 within the locking slot 322, as the arrow A in FIG. 1 indicates, the arrow E in FIG. 6 indicates, the arrow F in FIG. 7 indicates, the arrow G in FIG. 14 indicates, the arrow K in FIG. 27 indicates, or the arrow L in FIG. 28 indicates.

When the lock head 21 is rotated the staggered angle (as the angle θ, 90°, as shown in FIG. 3) within the locking slot 322 and the lengthwise central axis 32*b* of the armrest body 32 and the lengthwise central axis 11*b* of the mounting base 11 are coupled with each other (as shown in FIG. 1), the lock head 21 is stopped and positioned at the stopping position 323*a* of the travel area 323, as shown in FIG. 15. At the moment, the armrest body 32 and the lock head 21 are in a second assembled state, as shown in FIG. 1. The armrest 30 and the armrest support 10 are assembled with each other and fastened into one part.

Figure 10:
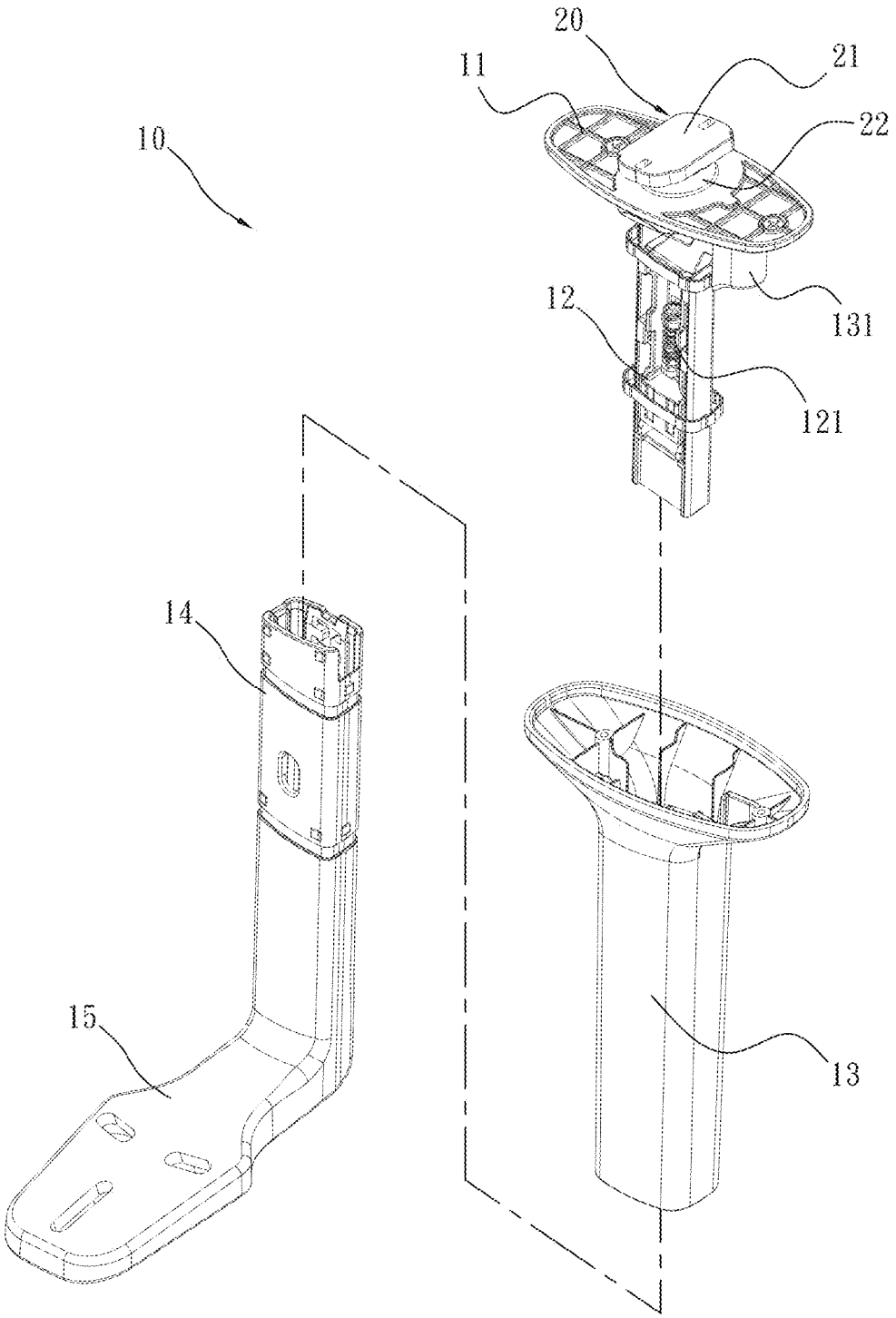
FIG. 10 is an explosive view of the embodiment in FIG. 9 in which the armrest support includes a long tube, a T-shaped rod and an outer sleeve according to the present invention.

Refer to FIG. 10 and FIG. 16, when the armrest support 10 further includes a long tube 14, a T-shaped rod 12 and an outer sleeve 13, the mounting base 11 is integrally formed on a top surface of the T-shaped rod 12.

Moreover, the T-shaped rod 12 is provided with a vertical moving member 121 (as shown in FIG. 10) while a button 131 is disposed on an upper part of the outer sleeve 13 for control of the vertical moving member 121 to allow upward/downward adjustment of the armrest support 10, as the arrow D in FIG. 1 indicates. Yet the mechanism allowing upward/downward adjustment is already available now and no more details are provided.

Figure 11:
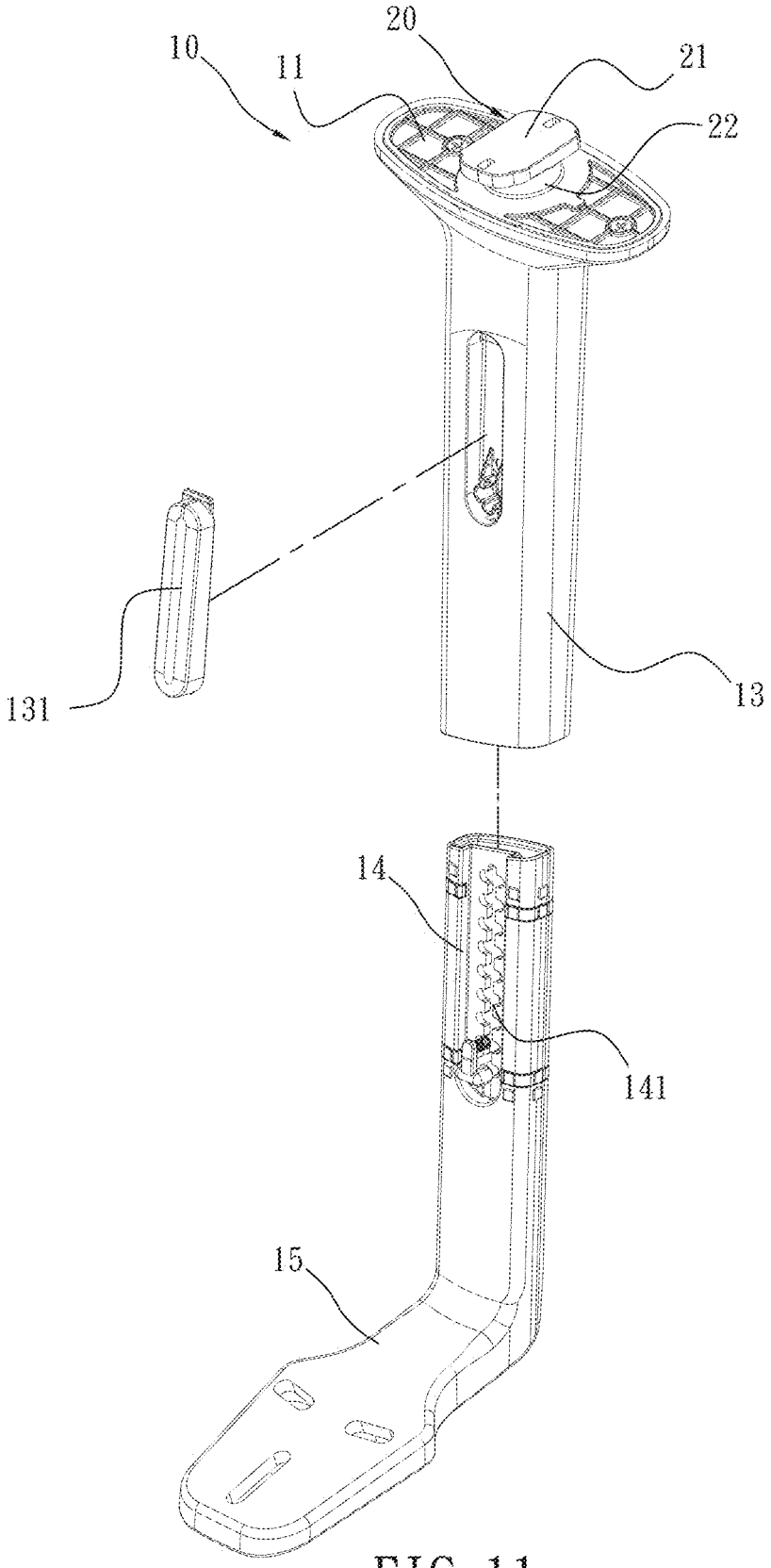
FIG. 11 is an explosive view of the embodiment in FIG. 9 in which the armrest support only includes a long tube and an outer sleeve (without a T-shaped rod) according to the present invention.

Refer to FIG. 11 and FIG. 17, when the armrest support 10 in this embodiment includes only a long tube 14 and an outer sleeve 13, without a T-shaped rod 12 (compared with the embodiment shown in FIG. 10), the mounting base 11 is integrally formed on a top surface of the outer sleeve 13. Thus both the process time and the production cost at the manufacturing end are reduced.

Moreover, the long tube 14 is provided with a vertical moving member 141 (as shown in FIG. 11) while a button 131 is arranged at an upper part of the outer sleeve 13 for control of the vertical moving member 141 to allow upward/downward adjustment of the armrest support 10, as the arrow D in FIG. 1 indicates. Yet the mechanism allowing upward/downward adjustment is already available now and no more details are provided.

Figure 23:
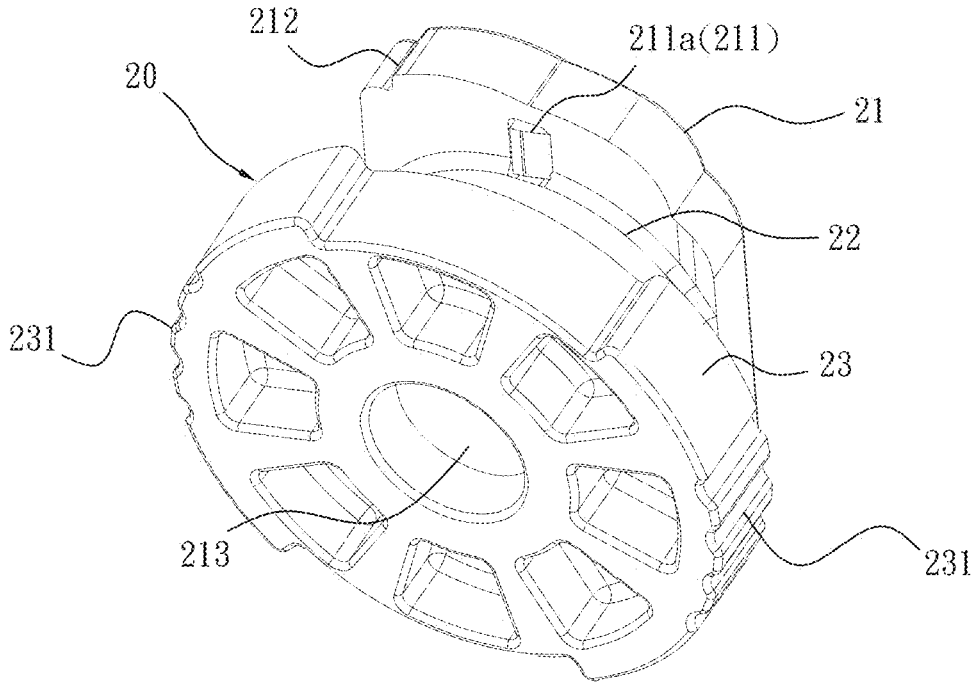
FIG. 23 is a perspective view showing a connecting portion viewed from an angle of an embodiment according to the present invention.

Refer to FIG. 7, FIG. 8, and FIG. 13-15, a set of locking mechanism (210, 320) used in combination with each other is disposed between the lock head 21 and the locking slot 322 so that the lock head 21 can be stopped and positioned at the stopping position 323*a* of the travel area 323 by the set of locking mechanism (210, 320) after being rotated horizontally along the travel area 323. Thus the tightness after assembly of the armrest 30 and the armrest support 10 in the second assembled state is enhanced by the set of locking mechanism (210, 320). Refer to FIG. 13-15, the set of locking mechanism (210, 320) includes at least one locking member 211 extending from the bottom of the locking head 21 and at least one positioning portion 324 disposed on the stopping position 323*a* of the armrest body 32 correspondingly. When the armrest body 32 and the lock head 21 are in the second assembled state (as shown in FIG. 1 and FIG. 6), the locking member 211 can just be locked into and positioned at the positioning portion 324 correspondingly, as shown in FIG. 15. The locking member 211 can be, but not limited to, an elastic locking bump 211*a*, as shown in FIG. 23.

Refer to FIG. 5-8, the set of locking mechanism (210, 320) further includes at least one locking-head slot 212 disposed on a vertical edge of the lock head 21 of the connecting portion 20 and at least one elastic locking bump 325 integrally formed on a vertical side wall of the locking slot 322 of the armrest body 32. When the armrest body 32 and the lock head 21 are in the second assembled state (as shown in FIG. 1 and FIG. 6), the elastic locking bump 325 can just be locked into and positioned at the locking-head slot 212 correspondingly (as shown in FIG. 6 and FIG. 7) so as to improve the tightness of the armrest 30 and the armrest support 10 assembled in the second assembled state (as shown in FIG. 1 and FIG. 6).

Figure 8:
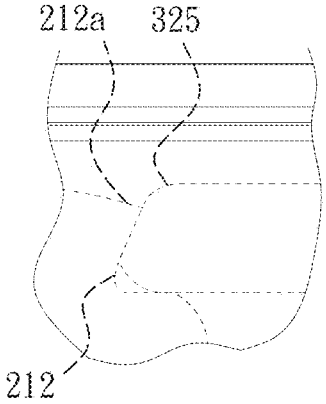
FIG. 8 is a partial enlarged view of the embodiment in FIG. 7 in which a locking-head slot is provided with a sharp (acute-angled) protrusion according to the present invention.
Figure 9:
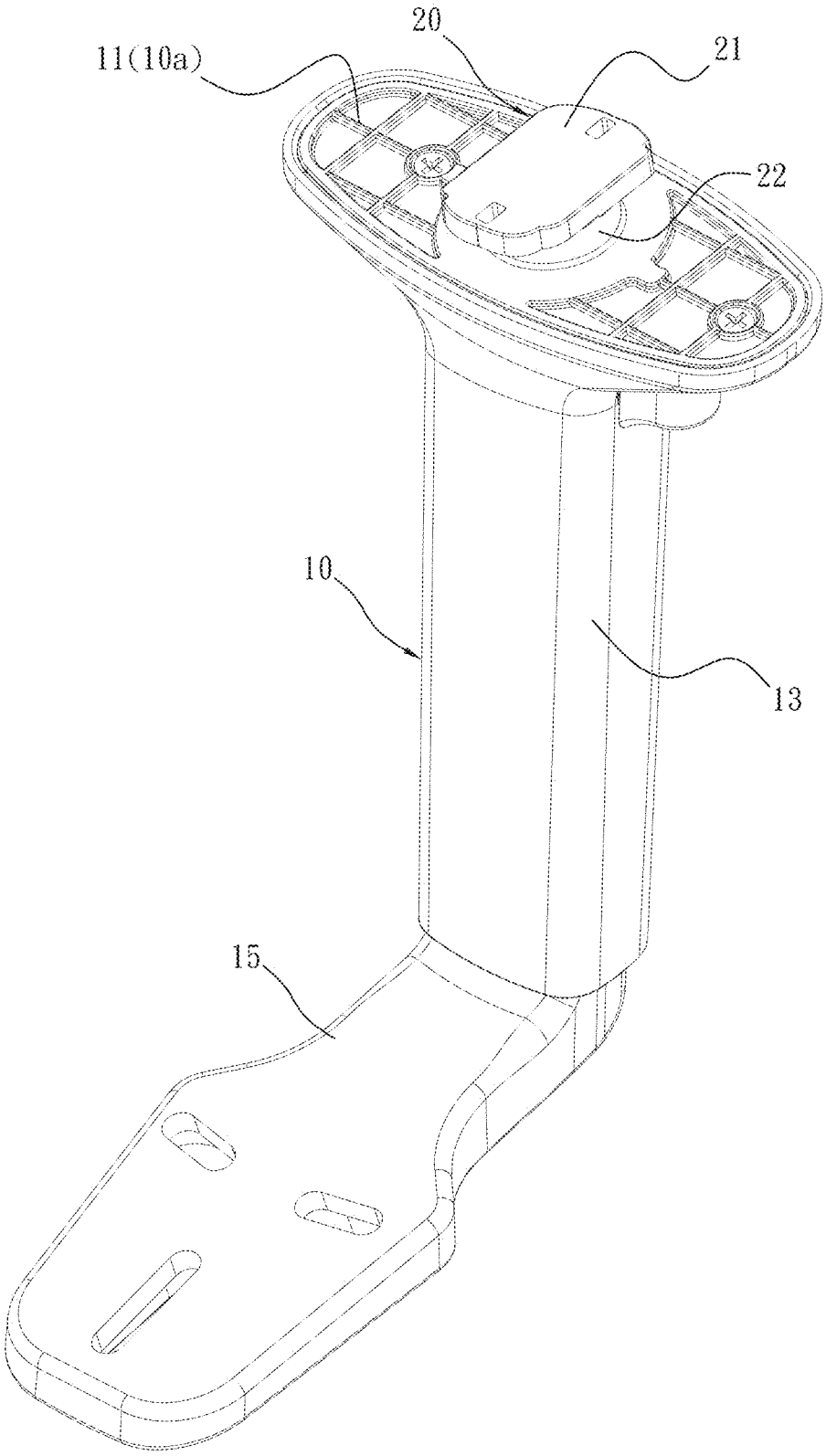
FIG. 9 is a perspective view of an embodiment in which an armrest support and a connecting portion are integrated into one part according to the present invention.

Furthermore, as shown in FIG. 8, the locking-head slot 212 is provided with a sharp (acute-angled) protrusion 212*a* for closely abutting against the elastic locking bump 325 to increase the tightness of the armrest 30 and the armrest support 10 assembled in the second assembled state (as shown in FIG. 1 and FIG. 6).

In addition, the set of locking mechanism (210, 320) are mainly used for improving the tightness of the armrest 30 and the armrest support 10 assembled and connected into one part. The structure and the style of the set of locking mechanism (210, 320) are not limited. For example, a stopper spring with a steel ball on a top thereof is locked into a hemispherical hole to form a locking mechanism, or an eccentric-circular arcuate convex surface is arranged at the side wall of the locking slot 322 so as to stop and position the lock head 21 being rotated. There are already several types of the set of locking mechanism available now.

Figure 12:
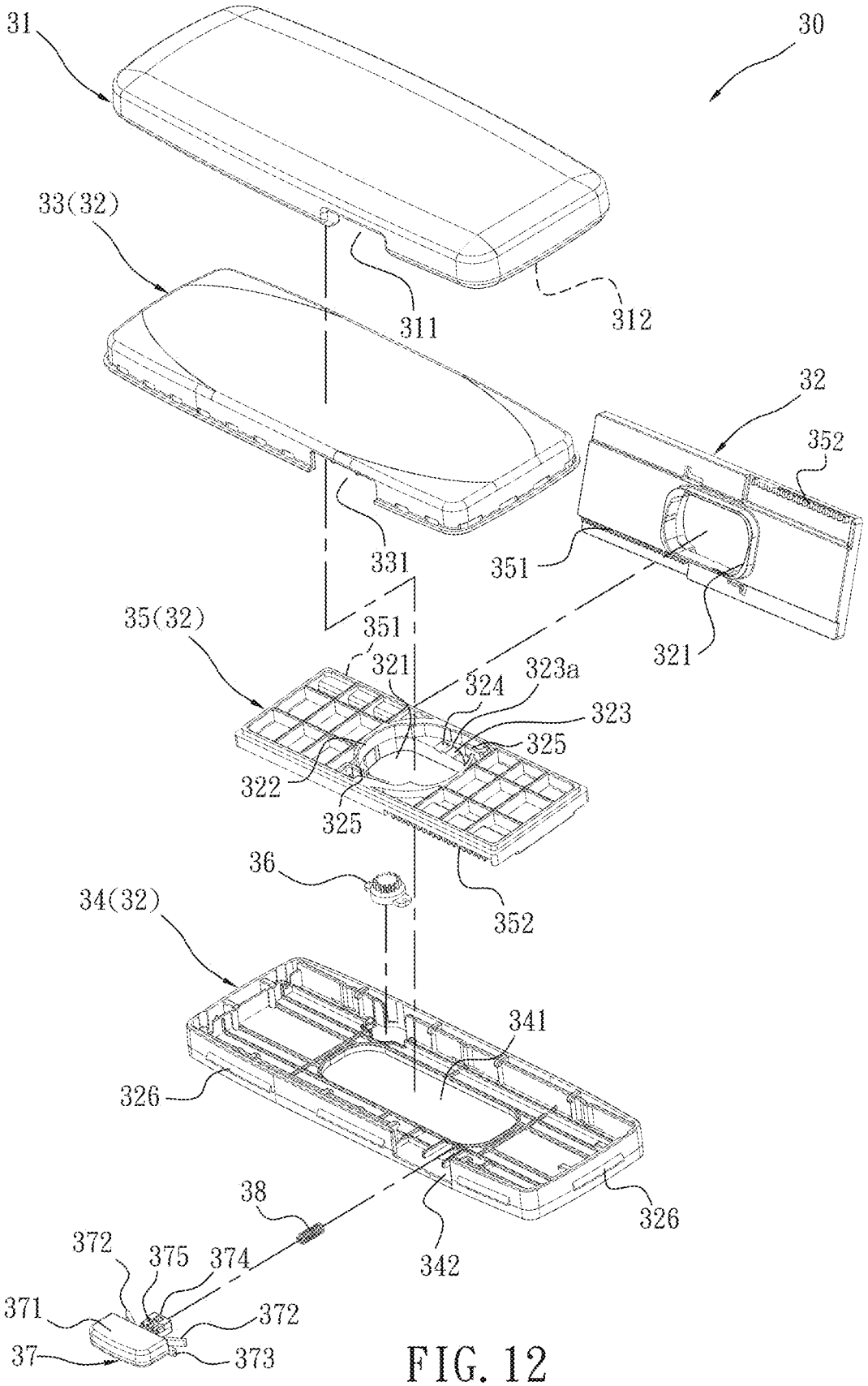
FIG. 12 is an explosive view of an embodiment of an armrest which includes an armrest pad, an armrest cover, a slide plate, and an armrest base from top to bottom in turn according to the present invention.
Figure 18:
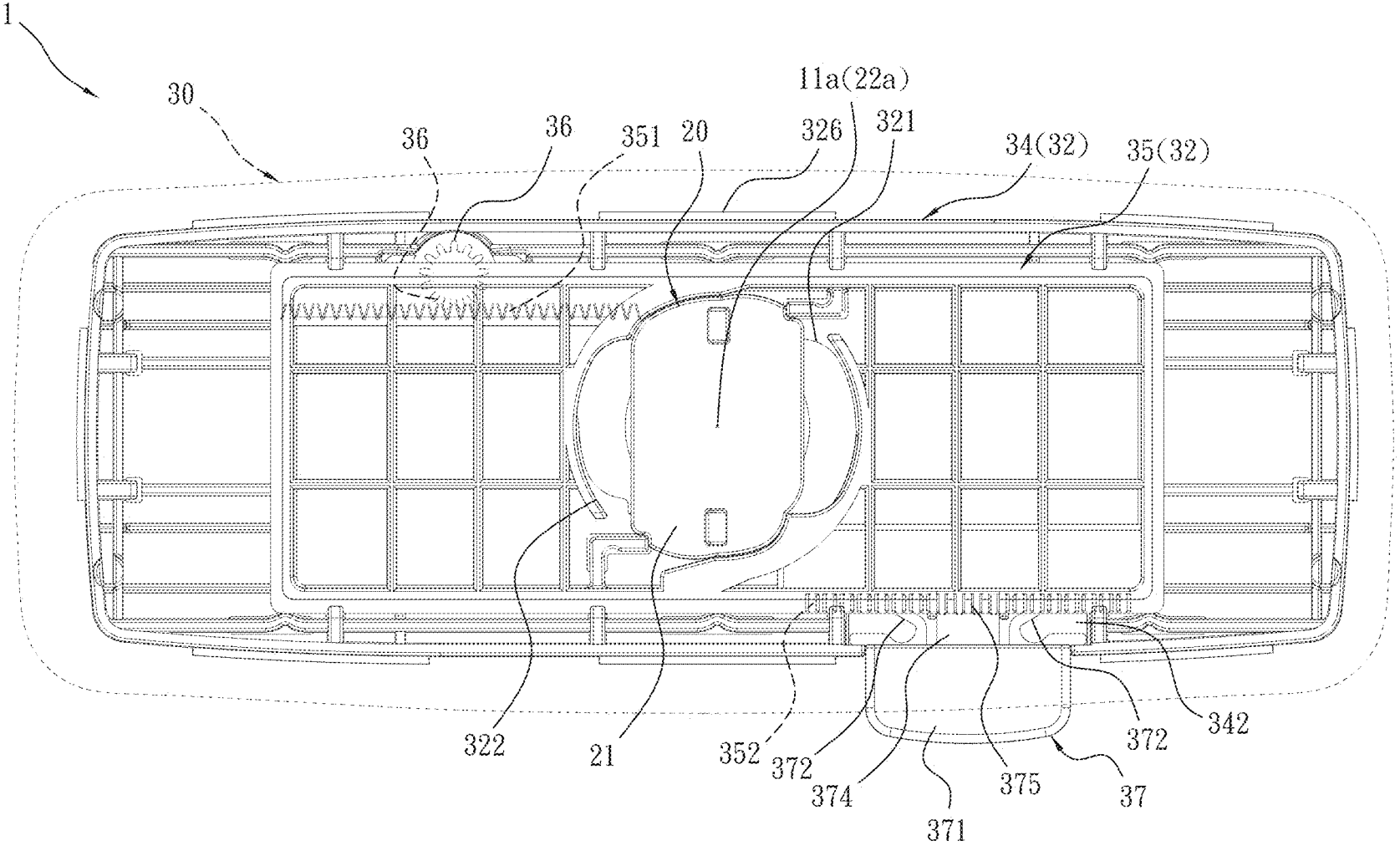
FIG. 18 is a schematic drawing showing top view of an embodiment in which an armrest and the armrest support are assembled into one part by a connecting portion integrally formed on a mounting base according to the present invention.
Figure 19:
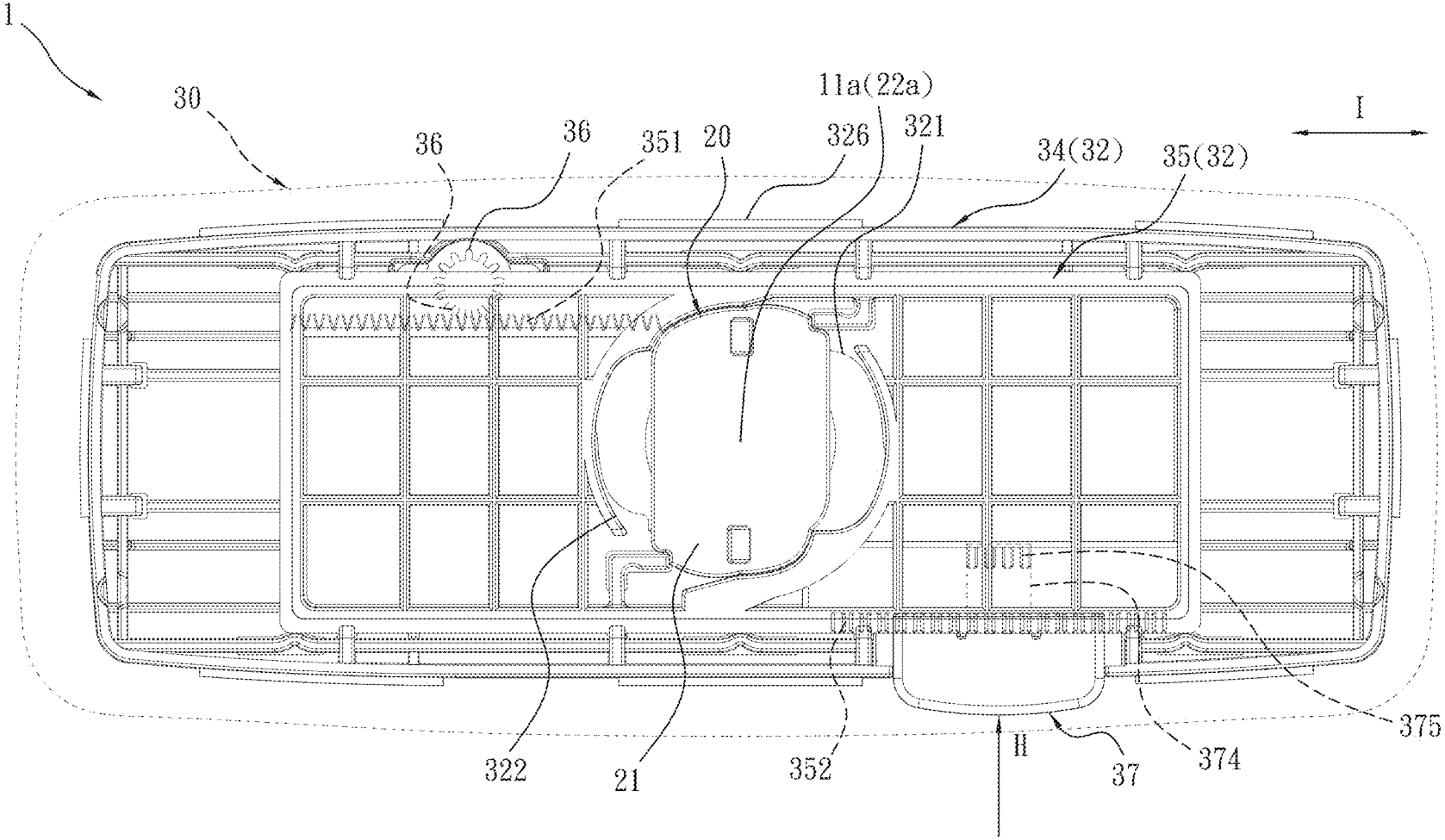
FIG. 19 is a top plan view of the embodiment in FIG. 18 in which a button in an armrest is pressed according to the present invention.
Figure 20:
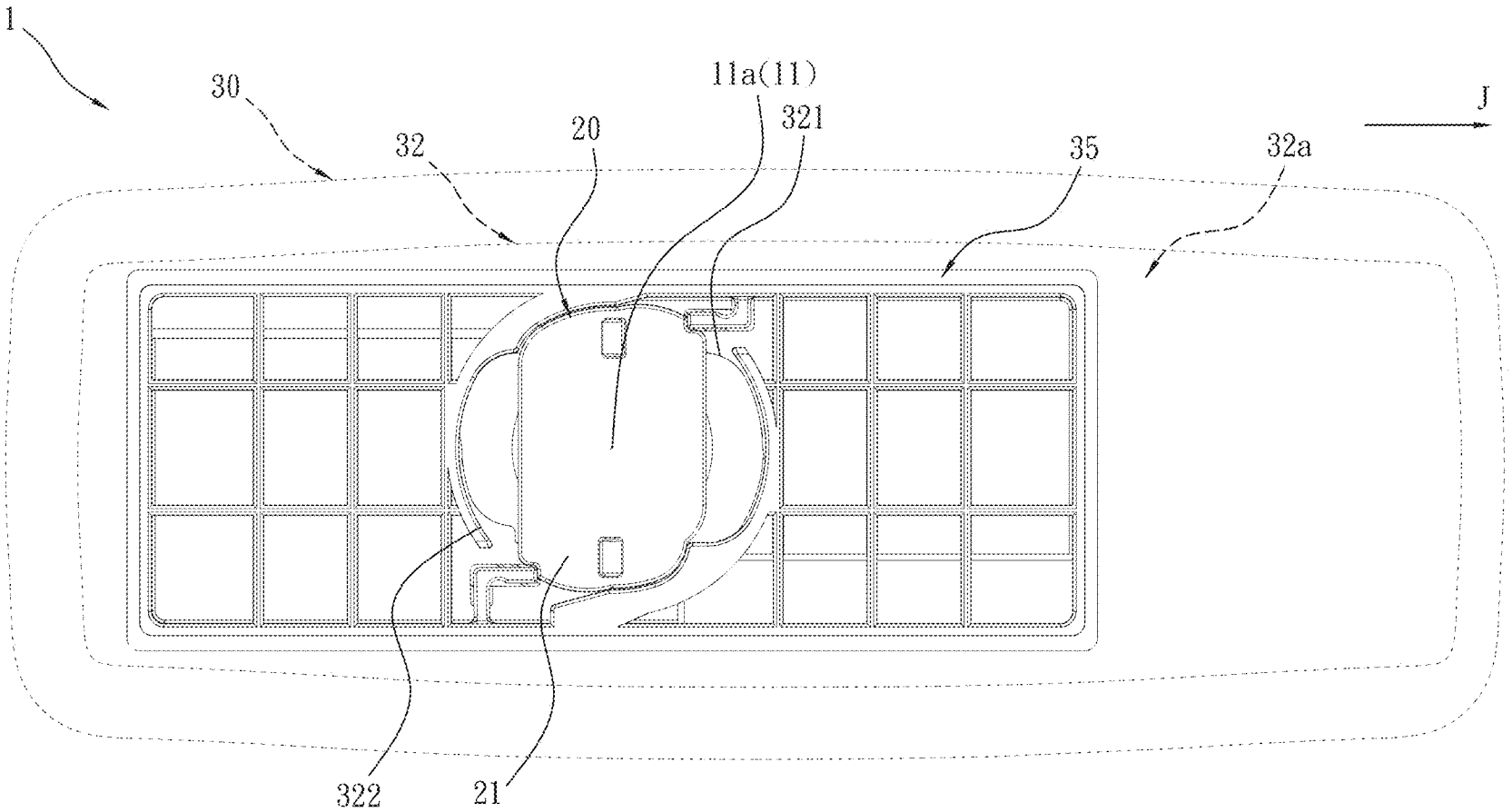
FIG. 20 is a top plan view of the embodiment in FIG. 19 showing a movement in the lengthwise direction performed after a button in an armrest is pressed according to the present invention.
Figure 29:
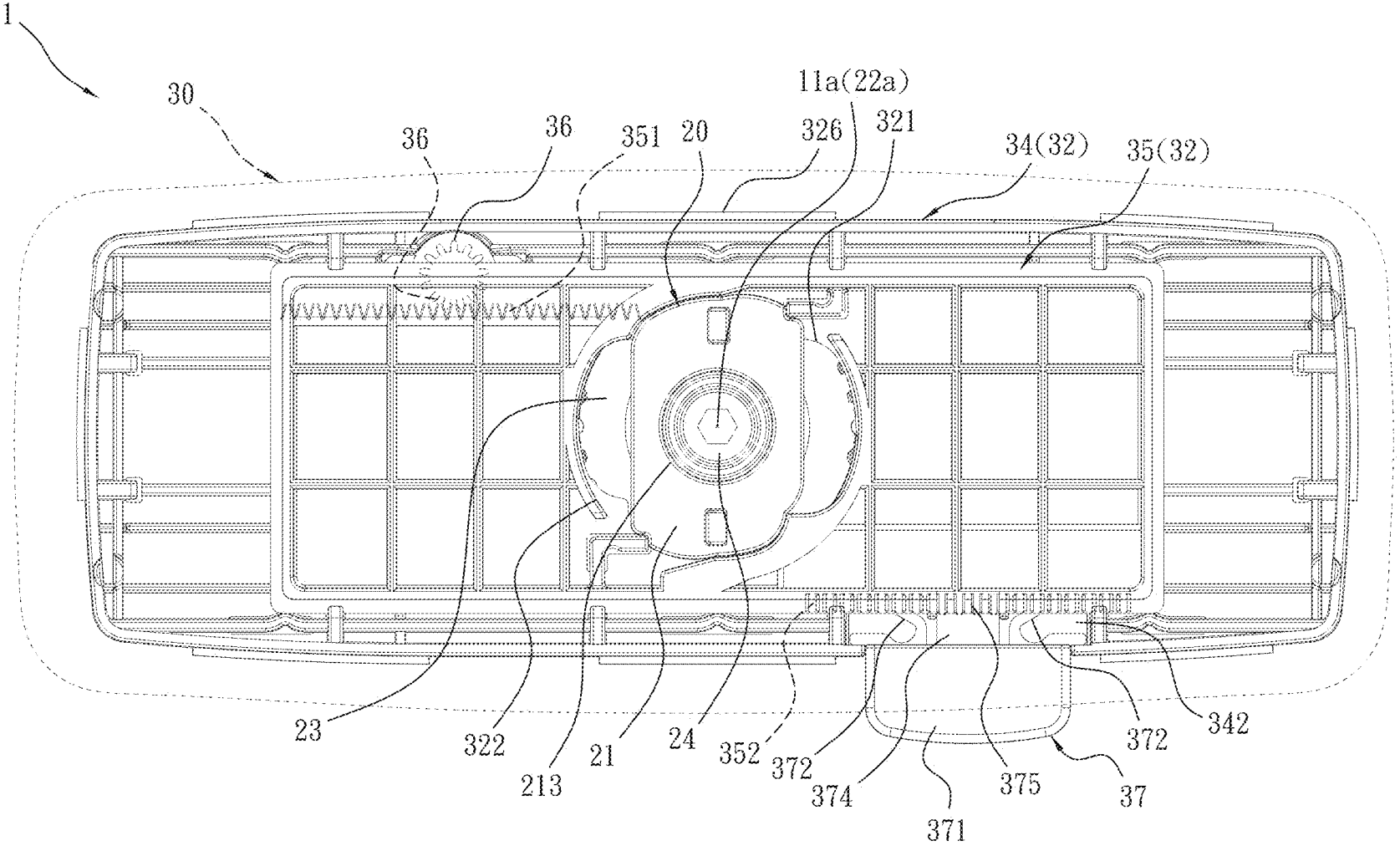
FIG. 29 is a top plan view of an embodiment (the second embodiment) in which an armrest is assembled with an armrest support into one part by a connecting portion detachably arranged at the mounting base according to the present invention.
Figure 30:
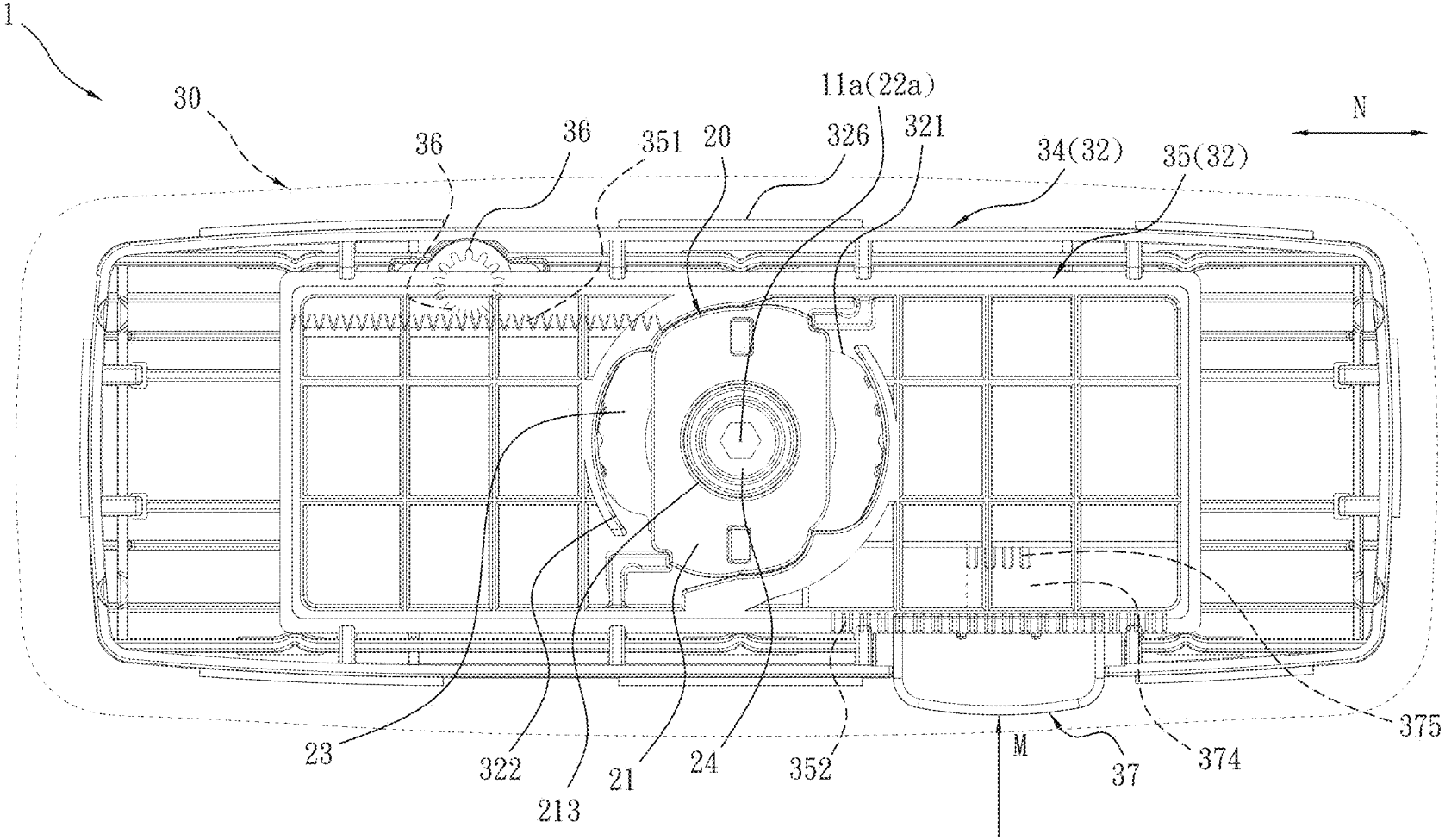
FIG. 30 is a top plan view of the embodiment in FIG. 29 in which a button in an armrest is pressed according to the present invention.
Figure 31:
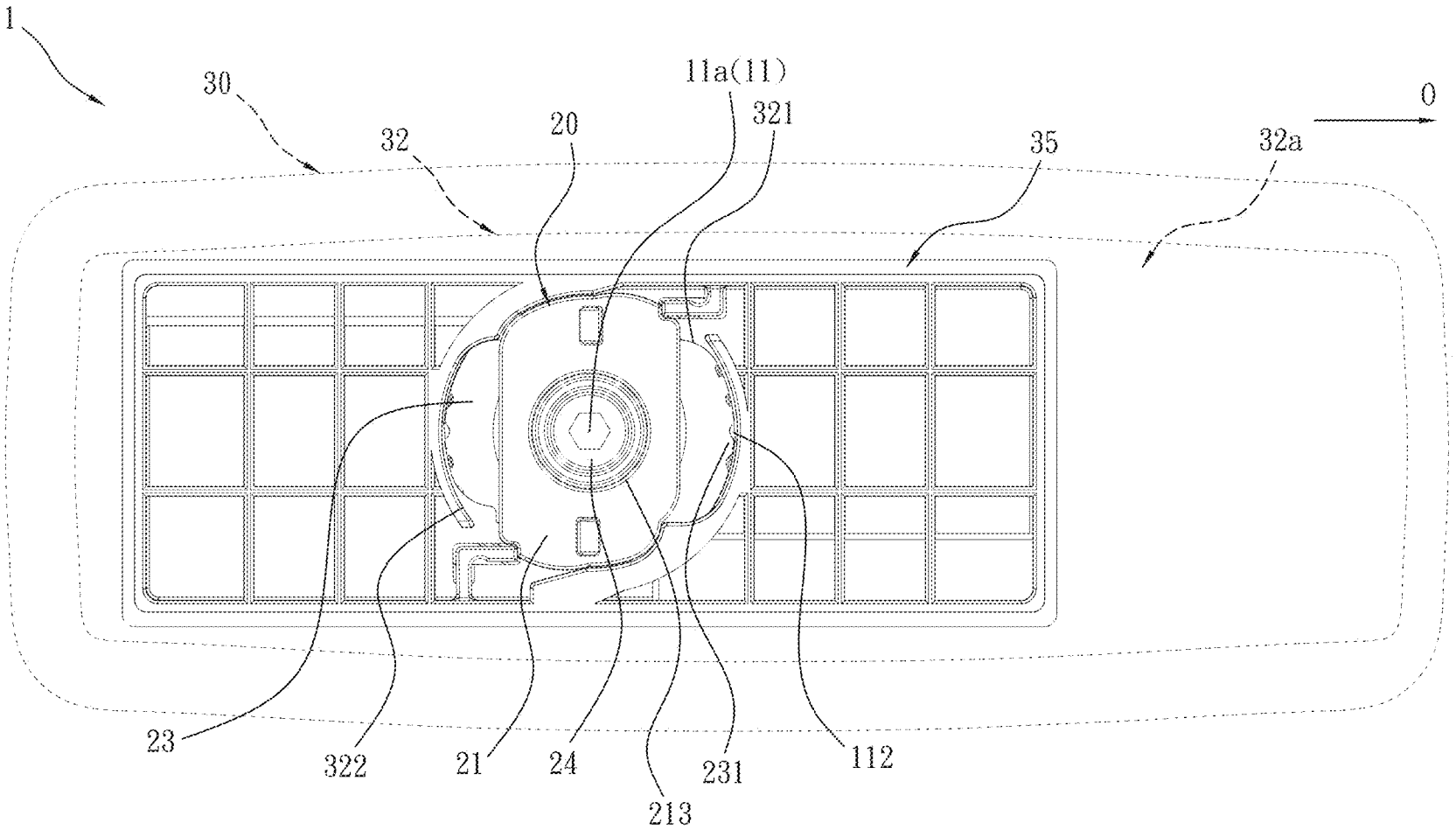
FIG. 31 is a top plan view of the embodiment in FIG. 30 showing a movement in the lengthwise direction performed after a button in an armrest is pressed according to the present invention.

Refer to FIG. 12, the armrest body 32 further includes an armrest cover 33, an armrest base 34 with an lengthwise armrest-base hole 341 on a middle of the bottom surface thereof, and a slide plate 35 provided with the locking hole 321 and the vertical locking slot 322 of the armrest body 32 on a top surface thereof. The armrest cover 33 and the armrest base 34 are assembled into one assembly and a rectangular space 32*a* is formed in the assembly, as shown in FIG. 16 and FIG. 17. The slide plate 35 is mounted in the rectangular space 32*a* of the assembly while the locking hole 321 of the slide plate 35 is mounted into the armrest-base hole 341 and able to be sliding in the armrest-base hole 341 along the lengthwise direction of the armrest-base hole 341, as the arrow J indicates in FIG. 20 and the arrow O indicates in FIG. 31. As shown in FIG. 18 and FIG. 29, the slide plate 35, the connecting portion 20 and the mounting base 11 are connected into one part and keeping still relative to the armrest support 10 after the armrest 30 and the armrest support 10 being in the second assembled state. The assembly of the armrest cover 33 and the armrest base 34 can be moved relative to the connecting portion 20 and the mounting base 11 in the lengthwise direction for adjustment of the position of the armrest 30 lengthways, as the arrow B indicates in FIG. 1, the arrow J indicates in FIG. 20, and the arrow O indicates in FIG. 31. Thus the chair armrest 1 has one more function—adjustment in the lengthwise direction.

Refer to FIG. 18, FIG. 19, FIG. 29, and FIG. 30, at least one damping gear 36 is disposed on the edge of the rectangular space 32*a* of the assembly of the armrest cover 33 and the armrest base 34. The slide plate 35 is further provided with at least one first rack 351 in the lengthwise direction thereof for being engaged with the damping gear 36 correspondingly. When the assembly of the armrest cover 33 and the armrest base 34 is moved lengthwise relative to the connecting portion 20 and the mounting base 11, the damping gear 36 is sliding along the first rack 351 of the slide plate 35 so as to make the assembly of the armrest cover 33 and the armrest base 34 move relative to the connecting portion 20 and the mounting base 11 in the lengthwise direction with damping, as the arrow I indicates in FIG. 19 and the arrow N indicates in FIG. 30. Therefore the lengthwise movement for adjustment becomes more smoothly and comfortably during the operation.

Refer to FIG. 12, FIG. 18-19, FIG. 29, and FIG. 30, the armrest pad 31, the armrest cover 33 and the armrest base 34 are all provided with an opening 311/331/342 formed on one side in the lengthwise direction and the openings 311, 331, 342 are communicating with one another for mounting a button 37 therein. A plate part 371 is disposed on an outer end of the button 37 while an elastic member 372 is arranged at an inner end of the button 37 and elastically abutting against a side wall on the opening 342 of the armrest base 34. A lengthwise connecting slide part 373 is set between the plate part 371 and the elastic member 372 while a projecting handle 374 projecting inward is arranged at an inner side wall of the connecting slide part 373 and a button rack 375 is disposed on the projecting handle 374. The slide plate 35 is further provided with a second rack 352 which is correspondingly engaged with the button rack 375. While the button rack 375 being engaged with the second rack 352 of the slide plate 35, the assembly of the armrest cover 33 and the armrest base 34 can't be moved relative to the connecting portion 20 and the mounting base 11 in the lengthwise direction, as shown in FIG. 18 and FIG. 29. When the plate part 371 of the button 37 is pressed inward (as the arrow H indicates in FIG. 19 and the arrow M indicates in FIG. 30), the button rack 375 on the projecting handle 374 of the button 37 is synchronously moved inward to be released from the second rack 352 of the slide plate 35. At the moment, the assembly of the armrest cover 33 and the armrest base 34 is able to be moved relative to the connecting portion 20 and the mounting base 11 in the lengthwise direction, as the arrow I indicates in FIG. 19 and the arrow N indicates in FIG. 30.

Figure 36:
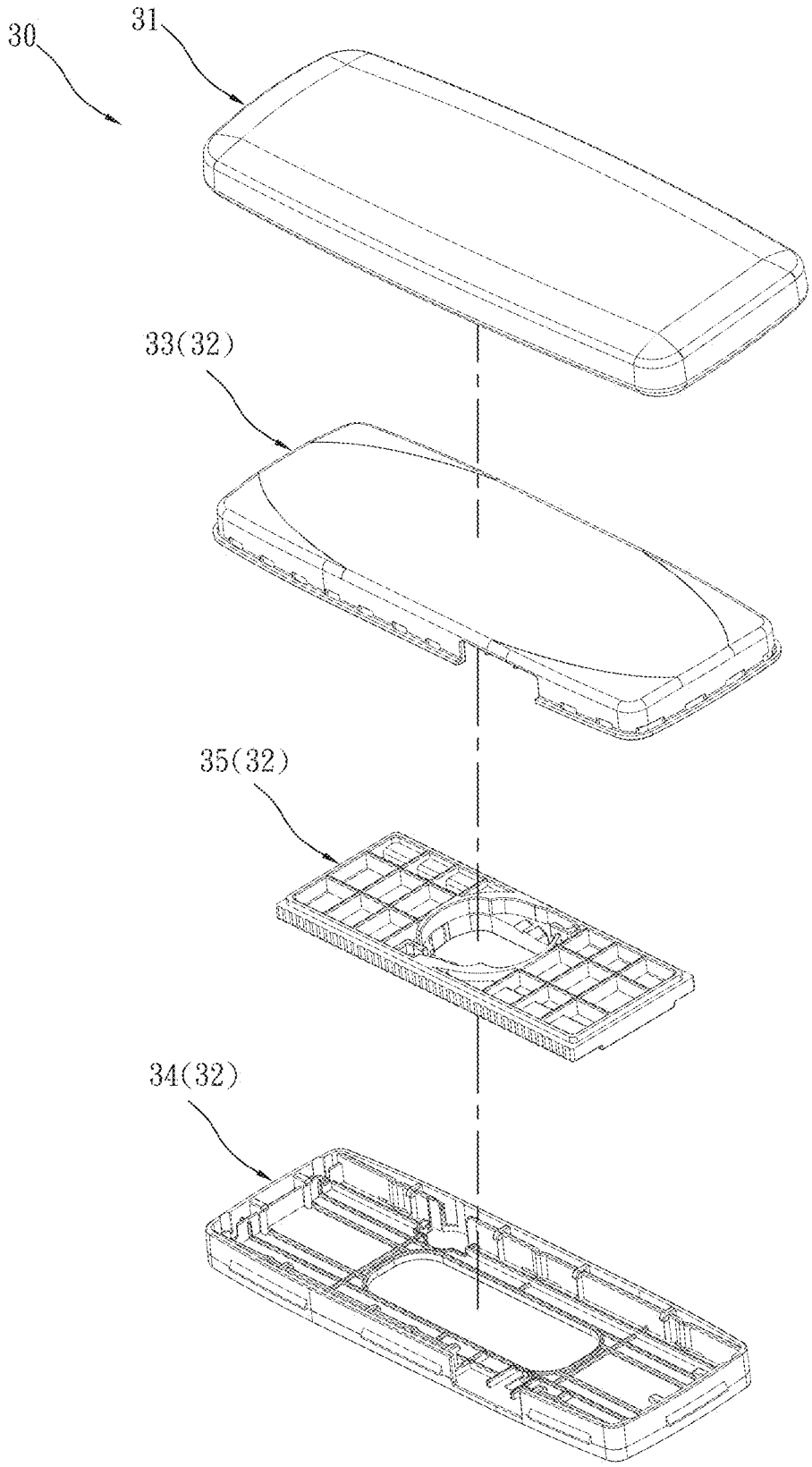
FIG. 36 is an explosive view of an embodiment in which an armrest pad of an armrest has no opening (no button mounted in the armrest for control of movement of the armrest) according to the present invention.

Moreover, as shown in FIG. 36, the armrest pad 31 can be designed to have no opening (as the opening 311 mentioned above). There is also no button mounted in the opening. Although the function of the button 37 is not available, the armrest 30 can still be adjusted in the lengthwise direction.

Figure 37:
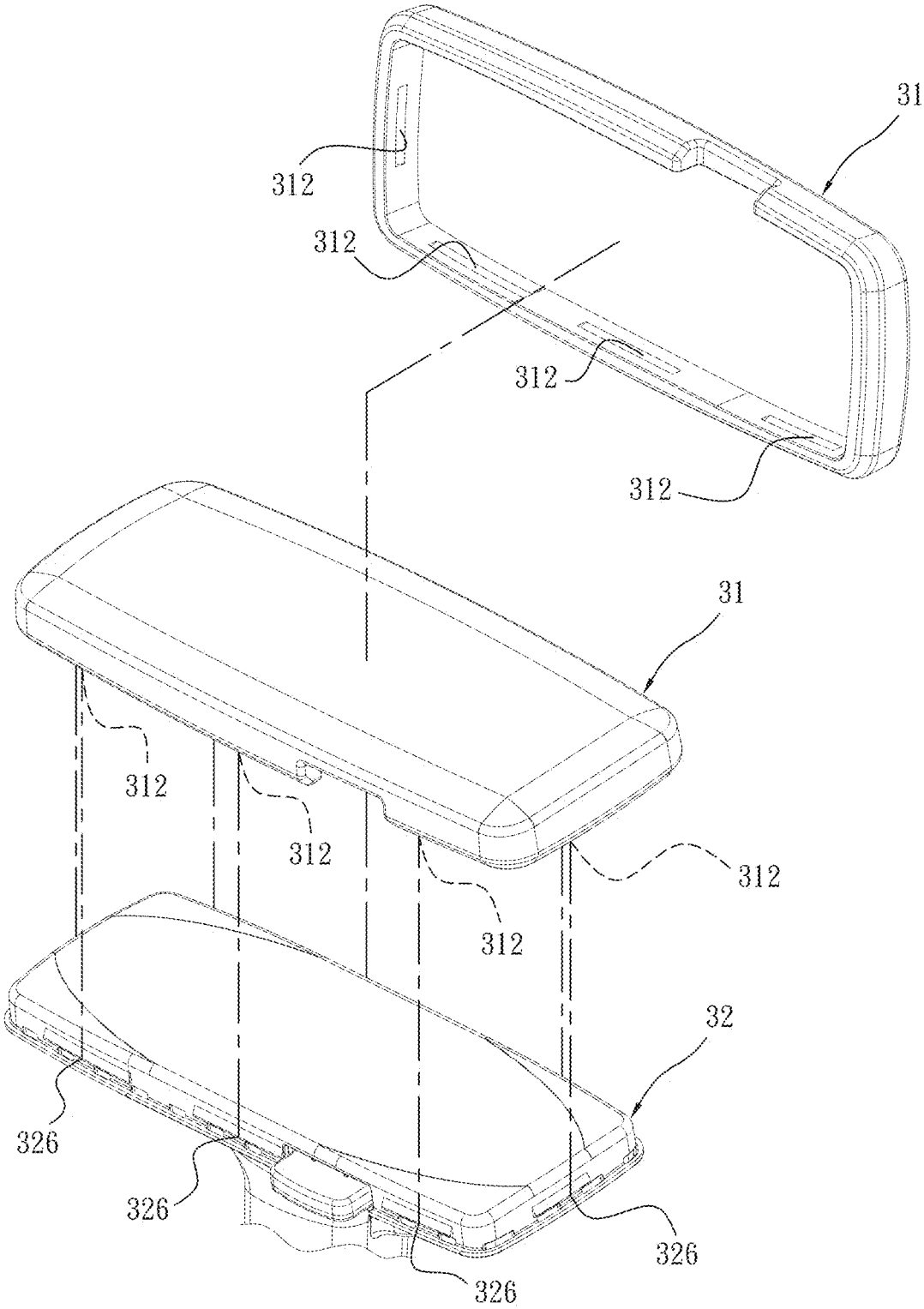
FIG. 37 is an explosive view of an embodiment in which an armrest pad and an armrest body are assembled like a locking member and a corresponding locking slot locked with and combined with each other according to the present invention.

Refer to FIG. 37, a mounting slot with an opening facing downward and at least one first locking portion 312 around the inner wall of the mounting slot are disposed on the bottom of the armrest pad 31. At least one second locking portion 326 is arranged around the armrest body 32 and used for being locked with the first locking portion 312 of the armrest pad 31. The first locking portion 312 of the armrest pad 31 and the second locking portion 326 of the armrest body 32 are used in combination with each other like the locking member and the corresponding locking slot. After the first locking portion 312 of the armrest pad 31 and the second locking portion 326 of the armrest body 32 being locked and fixed by each other, the armrest pad 31 and the armrest body 32 are assembled into one part. Thus the cost for assembling the armrest at the manufacturing end is saved.

In the first embodiment of the chair armrest 1 shown in FIG. 1-20, the connecting portion 20 is integrally formed on and projecting from the mounting base 11 of the armrest support 10. In another embodiment shown in FIG. 21-35, the connecting portion 20 is detachably arranged at and projecting from the mounting base 11 of the armrest support 10. Thereby the connecting portion 20 can be considered as a consumable. Once the connecting portion 20 is out of order, the damaged connecting portion 20 is replaced by a new one and the chair armrest 1 can continue to be used. Moreover, the components of the second embodiment in Fig. shown in FIG. 21-35 have the same reference numerals as those of the first embodiment shown in FIG. 1 and FIG. 3 are considered to be the same components in both embodiments. In both embodiments, the connecting portion 20 (that's the lock head 21) is selectively disposed on the armrest support 10 while the locking hole 321 and the locking slot 322 are selectively arranged at the armrest 30. The difference between the two embodiments is in that: the connecting portion 20 is integrally formed on and projecting from the mounting base 11 of the armrest support 10 in the first embodiment but in the second embodiment, the connecting portion 20 is detachably arranged at and projecting from the mounting base 11 of the armrest support 10. The first and the second embodiments have almost the same structure and the differences between the first and the second embodiments are described as follows.

Figure 22:
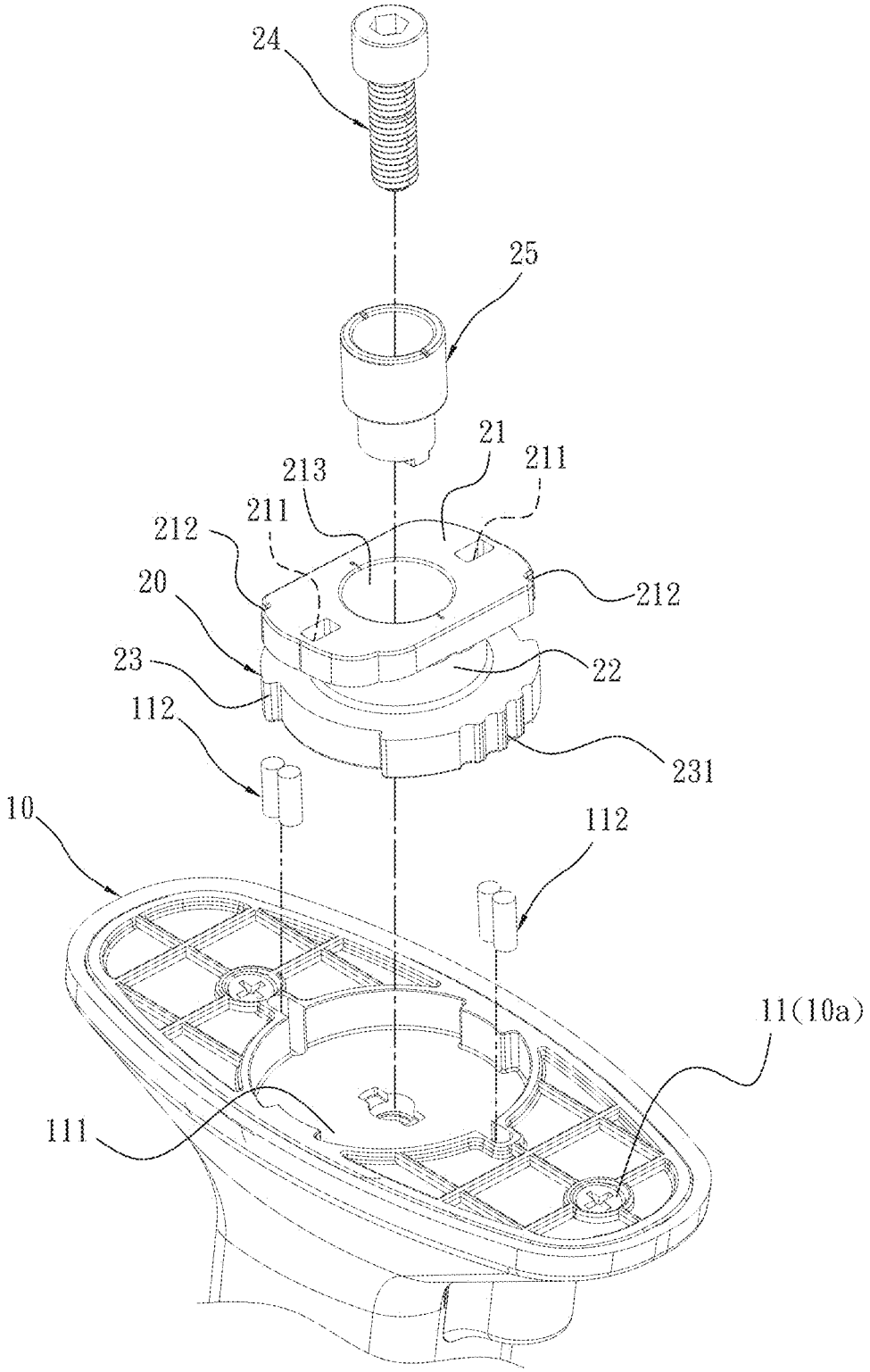
FIG. 22 is a partial enlarged explosive view of the embodiment in FIG. 21 according to the present invention.

In the second embodiment of the chair armrest 1 shown in FIG. 21-35, the connecting portion 20 is detachably arranged at and projecting from the mounting base 11 of the armrest support 10. The way by which the connecting portion 20 is assembled with the mounting base 11 is not limited. For example, as shown in FIG. 21, FIG. 22 and FIG. 32, a vertical step-like cylindrical hole 213 penetrating the connecting portion 20 is arranged at a center of the connecting portion 20 so that the connecting portion 20 is connected to and fixed on the mounting base 11 by a fastener 24 being inserted through the vertical step-like cylindrical hole 213 from top to bottom.

Figure 34:
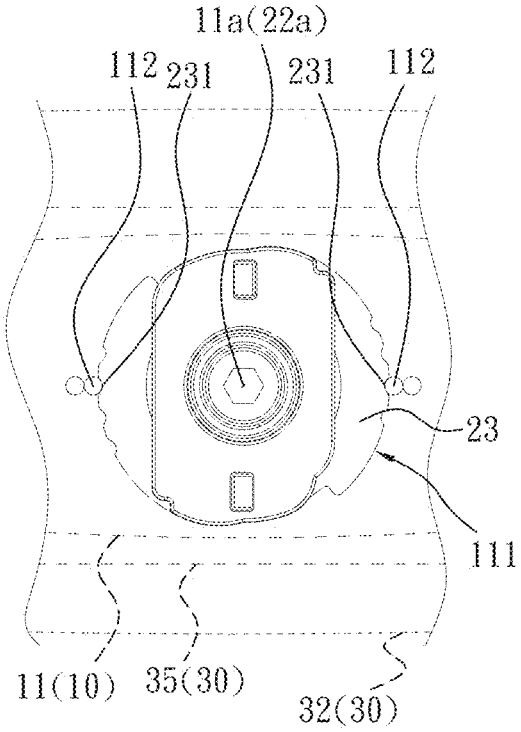
FIG. 34 is a partial enlarged view of the embodiment in FIG. 33 according to the present invention.
Figure 35:
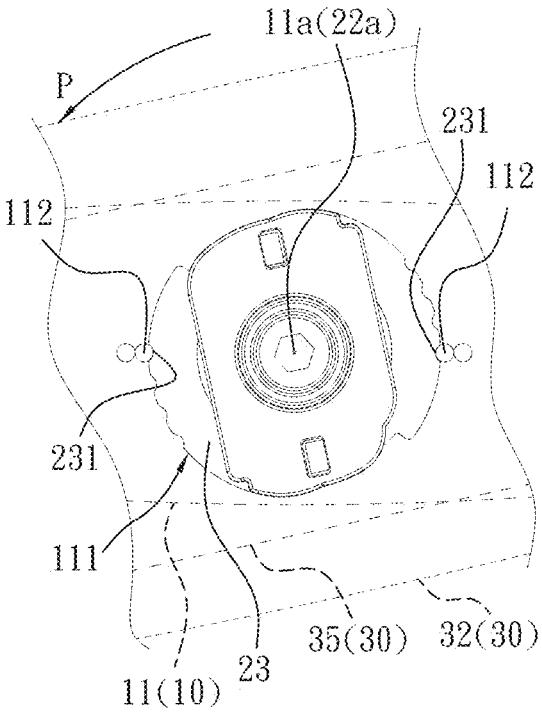
FIG. 35 is a schematic drawing showing the embodiment in FIG. 34 in which an armrest is rotated on a mounting base by a lock disk of a connecting portion according to the present invention.

Refer to FIG. 21-23 and FIG. 34-35, a lock disk 23 (as shown in FIG. 23) is arranged under the lock neck 22 of the connecting portion 20. A vertical step-like cylindrical hole 213 is disposed on a center of the connecting portion 20 and penetrating the connecting portion 20 while a positioning sleeve 25 is mounted in the vertical step-like cylindrical hole 213. The shape and the area of the horizontal section of the positioning sleeve 25 are corresponding to and smaller than those of the horizontal section of the vertical step-like cylindrical hole 213. By a fastener 24 being inserted through the vertical step-like cylindrical hole 213 and the positioning sleeve 25 from top to bottom, the connecting portion 20 is rotatably connected to the mounting base 11. A top surface of the mounting base 11 is provided with a rotary slot 111 whose shape and area of the horizontal section are corresponding to and larger than those of the horizontal section of the lock disk 23, as shown in FIG. 34 and FIG. 35. Refer to FIG. 21-22 and FIG. 25-28, the lock disk 23 can be rotated around the positioning sleeve 25 when the connecting portion 20 is connected to the mounting base 11. Thereby the lock disk 23 can also be moved and adjusted rotationally in the rotary slot 111 of the mounting base 11. When the armrest support 10 and the armrest 30 are in the second assembled state (as shown in FIG. 1), the armrest body 32 can be rotationally moved relative to the vertical central axis 11*a* of the mounting base 11 by the lock disk 23 for adjustment of the position, as the arrow C indicates in FIG. 1 and the arrow P indicates in FIG. 35. When the armrest body 32 is rotated and moved for adjustment of the position, the mounting base 11 keeps still while the lock disk 23 in the armrest body 32 is rotated in the rotary slot 111 of the mounting base 11 to make the connecting portion 20 and the armrest body 32 have rotationally movement and adjustment relative to the vertical central axis 11*a* of the mounting base 11, as the arrow C indicates in FIG. 1 and the arrow P indicates in FIG. 35.

Figure 33:
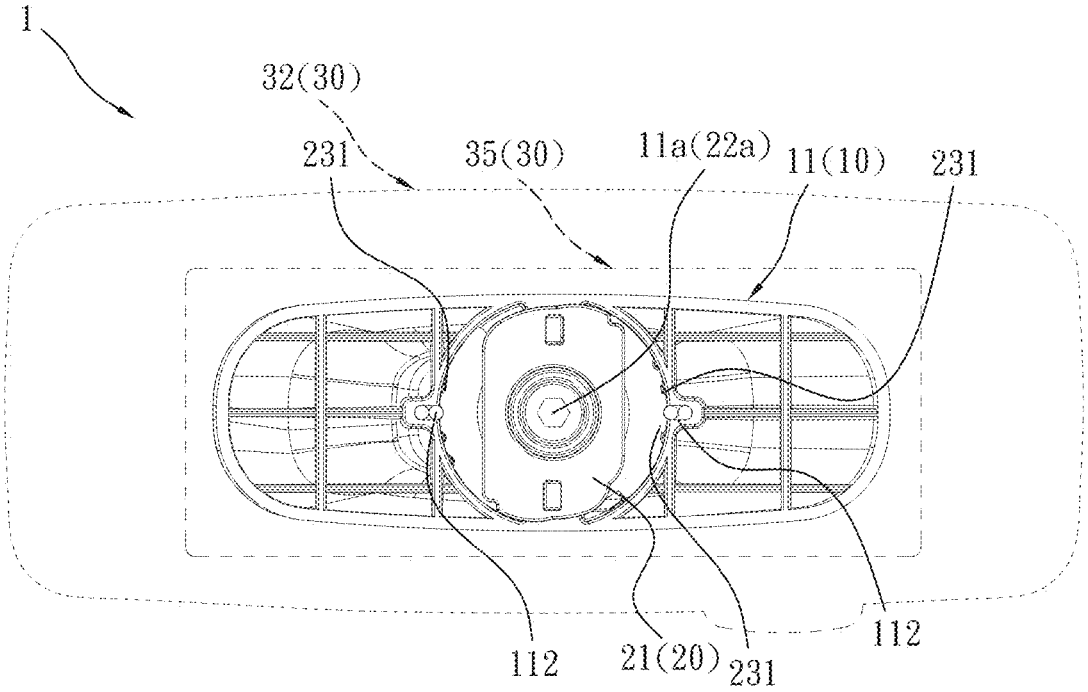
FIG. 33 is a top plan view of an embodiment (the second embodiment) in which a lock disk is mounted in a rotary slot of a mounting base according to the present invention.

Furthermore, the lock disk 23 of the connecting portion 20 is provided with at least one curved rack 231 having a central angle, as shown in FIG. 33-35. At least one positioning toothed block 112 is disposed on the rotary slot 111 of the mounting base 11 for being engaged with the curved rack 231 correspondingly, as shown in FIG. 33-35. The armrest body 32 is rotated a certain angle and then positioned in the rotary slot 111 by the curved rack 231 of the connecting portion 20 while being moved rotationally for adjustment of the position, as the arrow P indicates in FIG. 35.

As to the same feature in the structure of the first embodiment and the second embodiment (the lock head 21 of the connecting portion 20 is disposed on the armrest support 10 while the locking hole 321 and the locking slot 322 are arranged at the armrest 30), the lock head 21 of the connecting portion 20 and the locking hole 321 (or the locking slot 322) are used in combination with each other in male-female engagement. In the first and the second embodiments of the present invention, the positions of the components in male-female engagement can be switched. That means the position of the lock head 21 of the connecting portion 20 is switched from the armrest support 10 (in the first and the second embodiments) to the armrest 30 (in the third and the fourth embodiments) while the position of the locking hole 321 and the position of the locking slot 322 are changed from the armrest 30 (in the first and the second embodiments) to the armrest support 10 (in the third and the fourth embodiments). As to the functions of the structural features the third embodiment and the fourth embodiment respectively have functions of the structural features similar to those of the first embodiment and the second embodiment. The third and the fourth embodiments have the same feature that the position of the connecting portion (the lock head) is changed to the armrest while the position of the locking hole and the position of the locking slot are changed to be arranged at the armrest support. The difference between the third embodiment and the fourth embodiment is in that the connecting portion of the third embodiment is integrally formed and projecting from the bottom surface of the armrest body of the armrest while the connecting portion of the fourth embodiment is detachably arranged at the projecting from the bottom surface of the armrest body of the armrest.

Refer to FIG. 38-47, a third embodiment an easily assembled chair armrest 2 is revealed. The easily assembled chair armrest 2 consists of an armrest support 40, a connecting portion 50 and an armrest 60.

Figure 38:
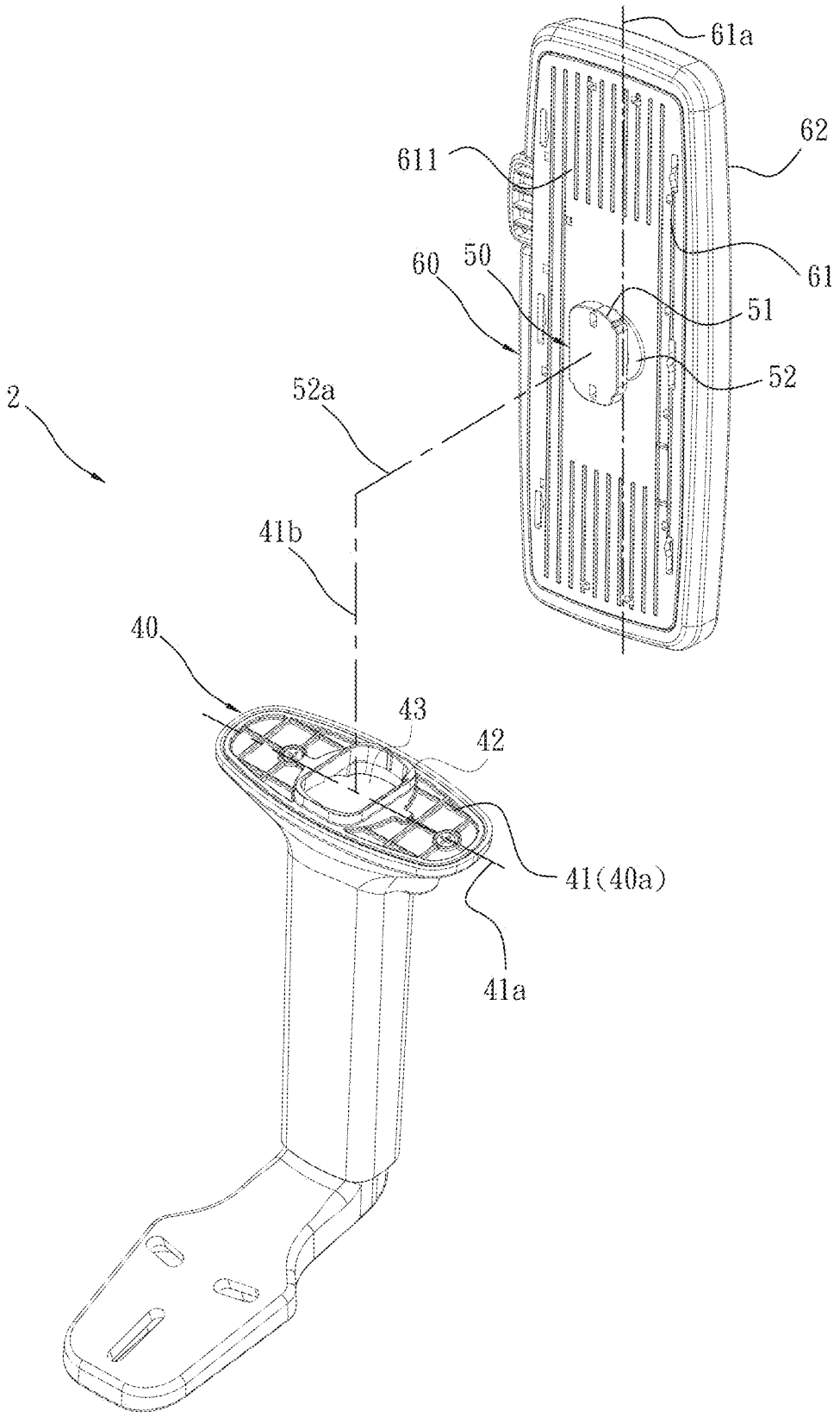
FIG. 38 is an explosive view of a further embodiment (a third embodiment) in which a lock hole is aligned with a lock head according to the present invention.
Figure 39:
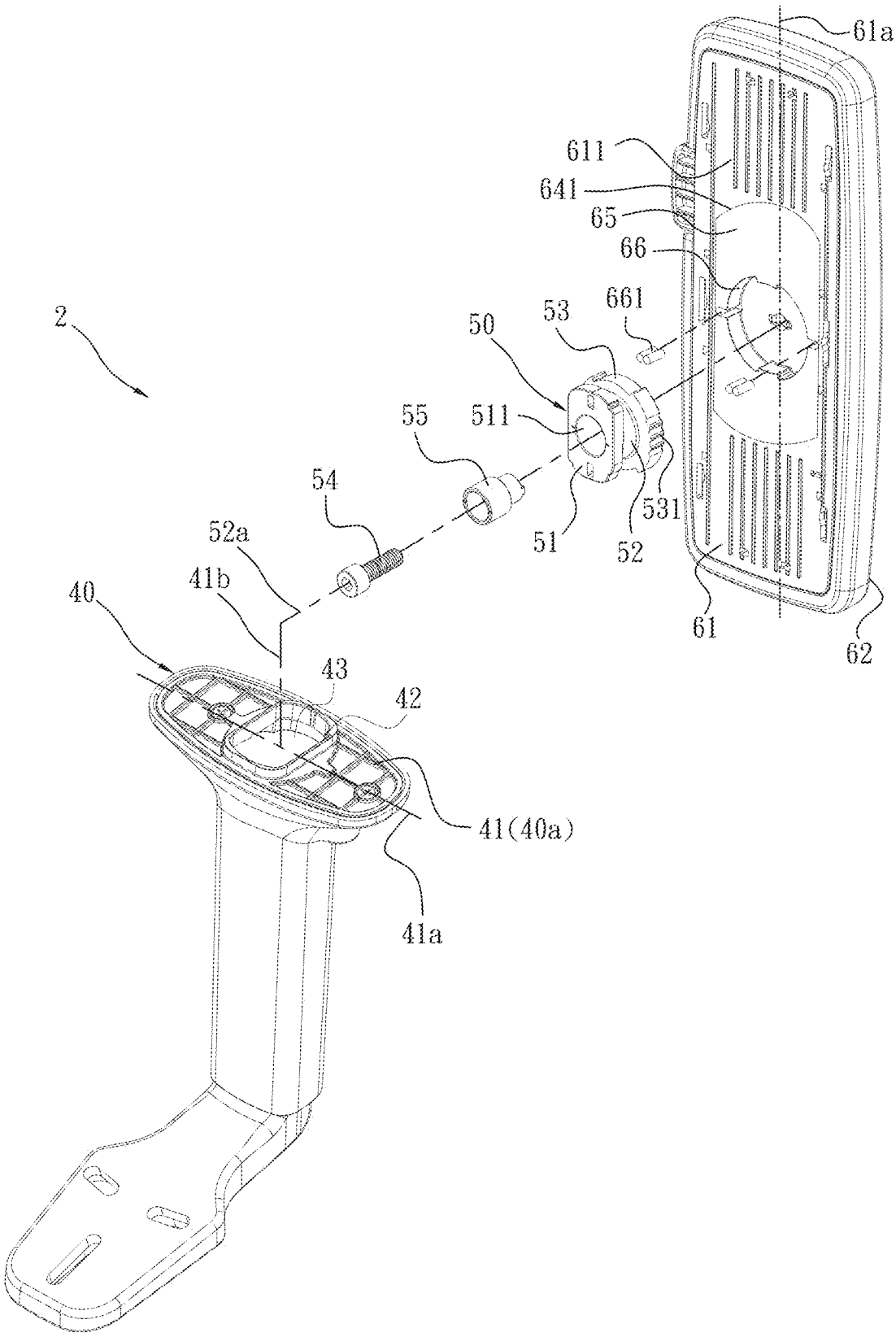
FIG. 39 is an explosive view of a further embodiment (a fourth embodiment) in which a lock hole is aligned with a lock head according to the present invention.
Figure 41:
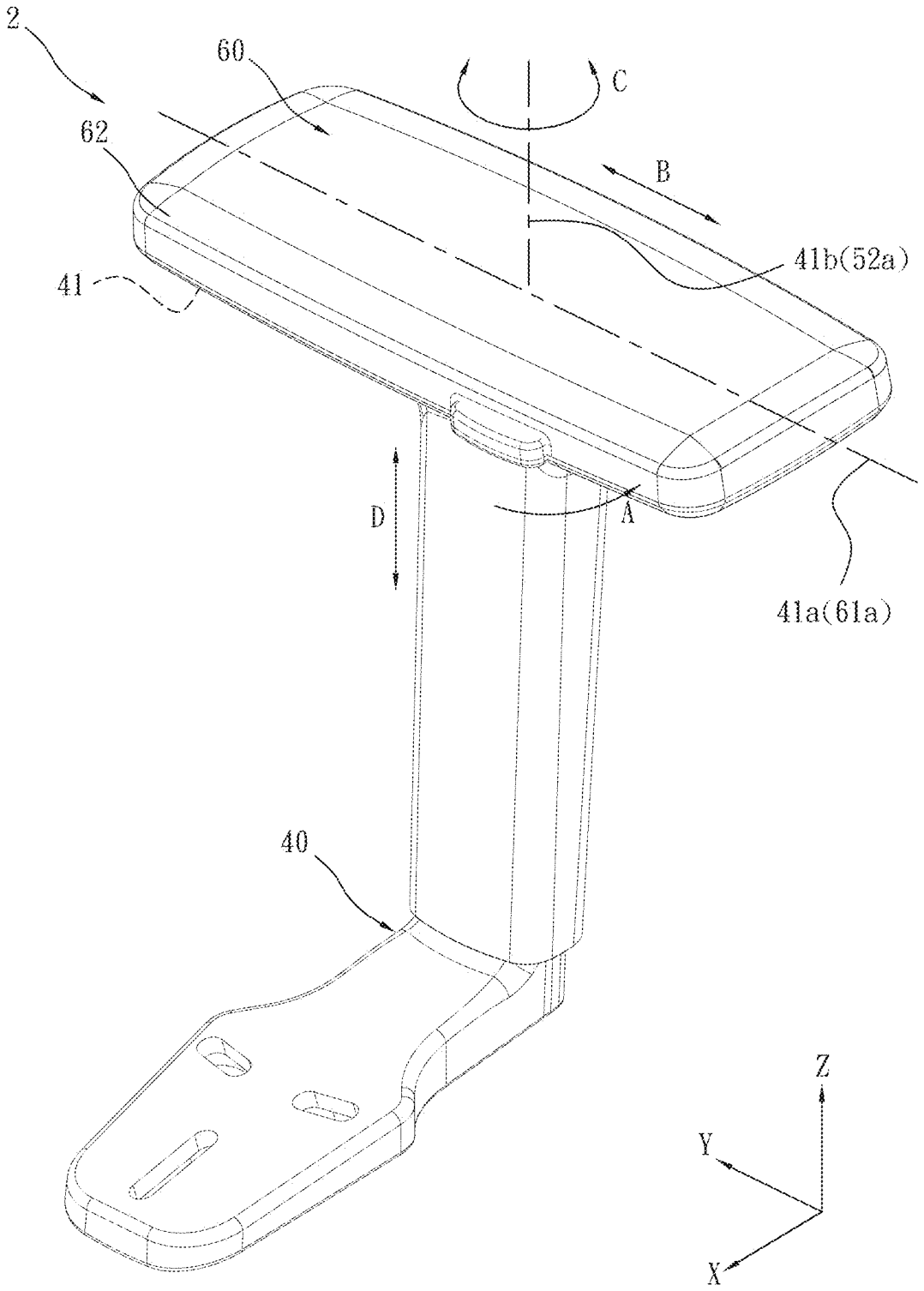
FIG. 41 is a perspective view of the embodiment in FIG. 38 or FIG. 39 in which a lock head and an armrest support are in a second assembled state according to the present invention.

Refer to FIG. 38, FIG. 39, and FIG. 41, armrest support 40 includes a top surface 40*a* while a mounting base 41 is disposed on the top surface 40*a*. The mounting base 41 includes a lengthwise central axis 41*a* in the lengthwise direction thereof while a locking hole 42 arranged at a top surface of the mounting base 41 and a vertical locking slot 322 with a certain depth is communicating with and disposed in the locking hole 42. The shape of a horizontal section of the locking hole 42 can be an ellipse, a rectangle or a triangle.

Refer to FIG. 38 and FIG. 39, the connecting portion 50 includes a lock head 51 with a certain thickness in the vertical direction and a lock neck 52 disposed under and connected to the lock head 51. The lock neck 52 includes a vertical central axis 52*a*. The shape of a horizontal section of the lock head 51 can be an ellipse, a rectangle or a triangle.

As shown in FIG. 38 and FIG. 39, the armrest 60 is composed of an armrest body 61 and an armrest pad 62 which is connected to and disposed over armrest body 61. The armrest body 61 has a lengthwise central axis 61*a*.

Figure 42:
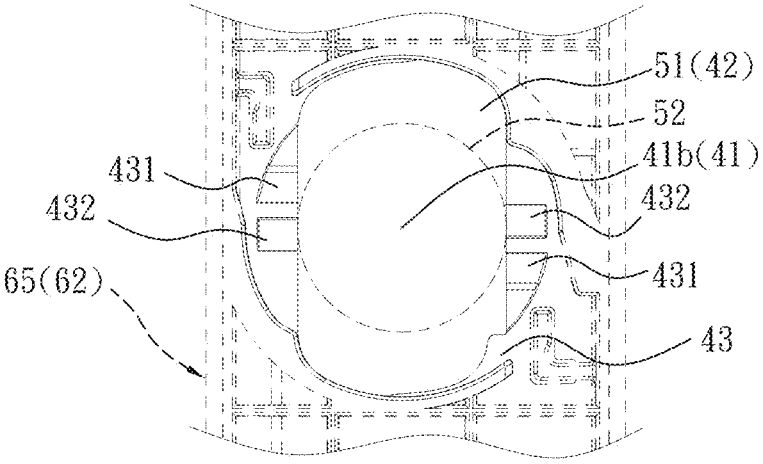
FIG. 42 is a top plan view of the embodiment in FIG. 41 in which a lock head hasn't reached a stopping position according to the present invention.
Figure 43:
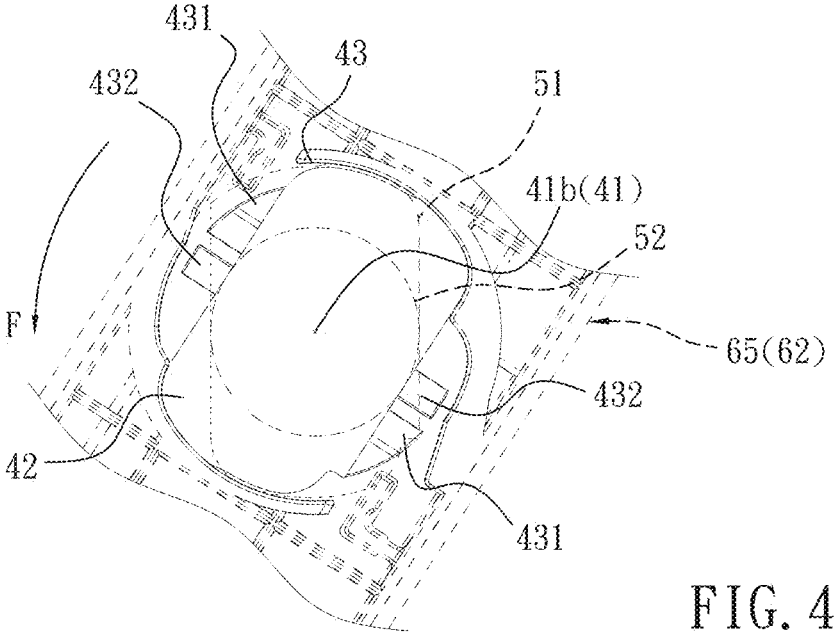
FIG. 43 is a top plan view of the embodiment in FIG. 42 in which an armrest is rotated according to the present invention.
Figure 44:
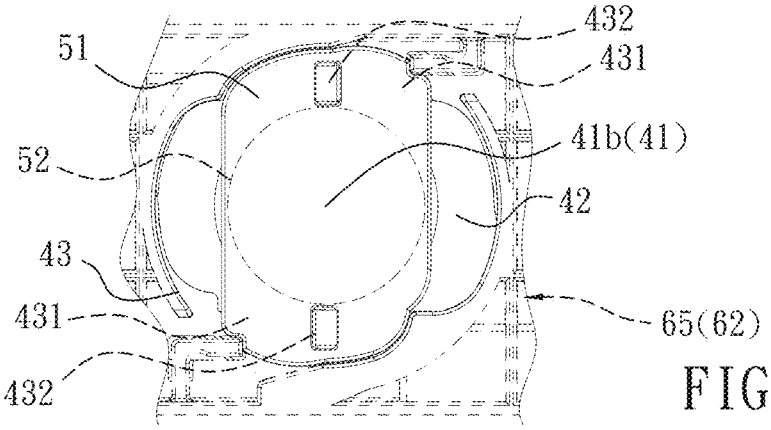
FIG. 44 is a top plan view of the embodiment in FIG. 43 in which a lock head has reached a stopping position according to the present invention.

Refer to FIG. 42-47, the shape and the area of the horizontal section of the locking hole 42 of the armrest support 40 are a bit larger than those of the lock head 51 of the connecting portion 50 so that the lock head 51 can be vertically mounted into the locking hole 42 and located in the locking slot 43, as shown in FIG. 42. The shape and the area of the horizontal section of the locking slot 43 of the armrest support 40 are larger and including the shape and the area of the horizontal section of the lock head 51 of the connecting portion 50 so that the locking slot 43 includes at least one more travel area 431 than the lock head 51, as shown in FIG. 42-44. After being vertically mounted into the locking slot 43, the lock head 51 can be rotated horizontally along the respective travel area 431 (as the arrow F in FIG. 43 indicates) and then stopped and positioned at a stopping position 432 on the travel area 431, as shown in FIG. 44.

Refer to FIG. 38 and FIG. 39, the lock head 51 of the connecting portion 50 can be vertically mounted into the vertical locking slot 43 through the locking hole 42 when the locking hole 42 of the armrest support 40 and the lock head 51 of the connecting portion 50 are aligned with each other vertically, as shown FIG. 42. Now the armrest support 40 and the lock head 51 are in a first assembled state, as shown in FIG. 40.

Figure 40:
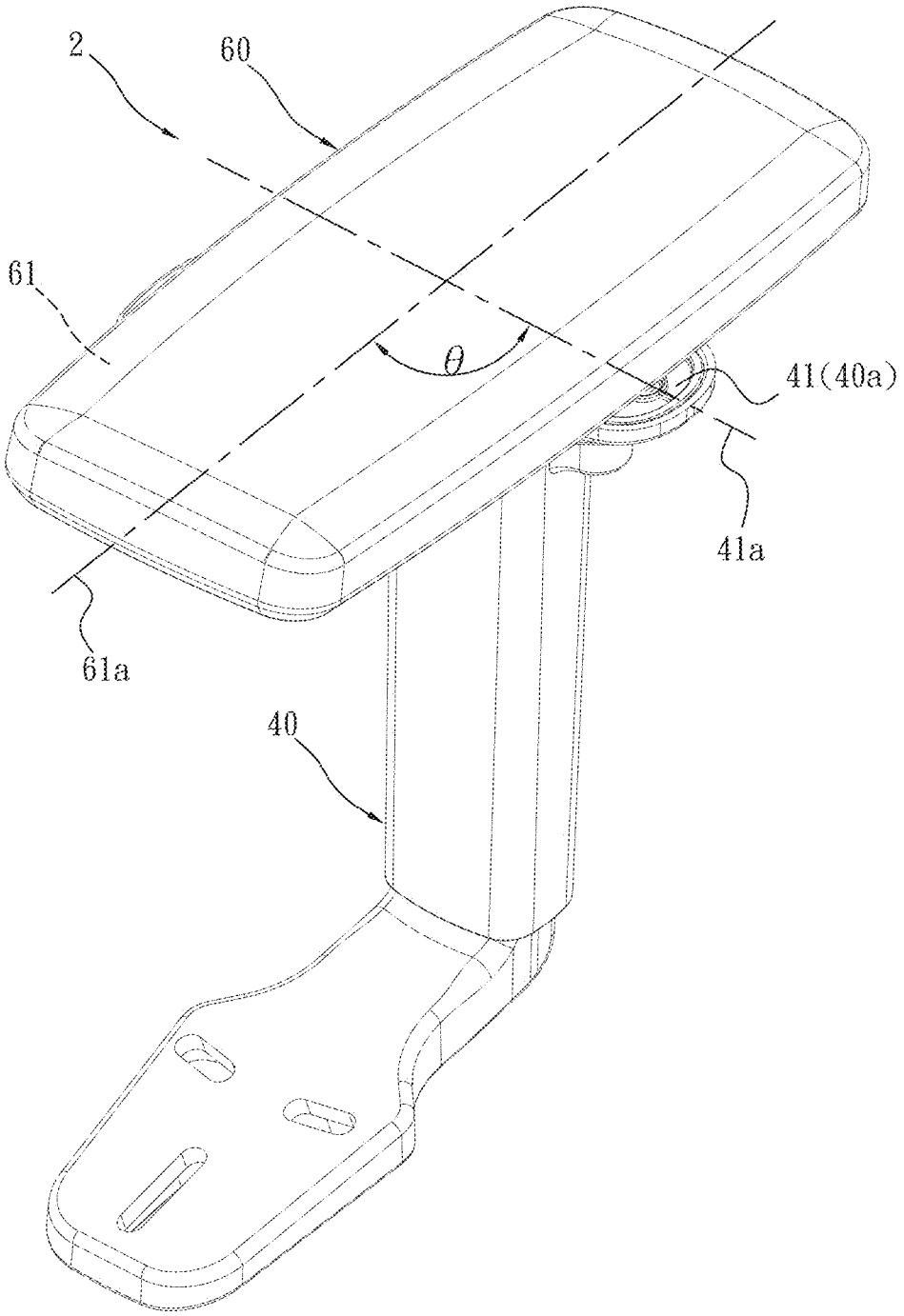
FIG. 40 is a perspective view of the embodiment in FIG. 38 or FIG. 39 in which a lock head and an armrest support are in a first assembled state according to the present invention.

With reference to FIG. 40, while the armrest support 40 and the lock head 51 are in a first assembled state, there is a staggered angle θ formed between the lengthwise central axis 41*a* of the mounting base 41 and the lengthwise central axis 61*a* of the armrest body 61. The staggered angle θ can be designed to range from zero to 180°. In this embodiment, the staggered angle θ is 90°

While in the first assembled state, the assembly relationship of the lock head 51, the lock neck 52, the locking hole 42 and the locking slot 43 can be: the lock head 51 is just abutting against the wall surface of the locking slot 43 and the lock neck 52 is completely located in the locking hole 42 (not shown in figure), the lock head 51 is just abutting against the wall surface of the locking slot 43 while a part of the lock neck 52 is exposed and located outside the locking hole 42 (not shown in figure), or the depth of the wall surface of the locking slot 43 is larger than the thickness of the lock head 51 while the lock neck 52 is completely located in the locking hole 42 (not shown in figure).

Refer to FIG. 40 and FIG. 43, when the lock head 51 and the armrest support 40 are in the first assembled state, the lock head 51 can be rotated horizontally around the vertical central axis 52*a* of the lock neck 52 within the locking slot 43, as the arrow A in FIG. 41 indicates and the arrow F in FIG. 43 indicates Refer to FIG. 41 and FIG. 44, when the lock head 51 is rotated a staggered angle θ (such as 90°) within the locking slot 43 while the lengthwise central axis 41*a* of the mounting base 41 and the lengthwise central axis 61*a* of the armrest body 61 are coupled with each other, the lock head 51 is stopped and positioned at the stopping position 432 on the travel area 431. Now the lock head 51 and the armrest support 40 are in a second assembled state while the armrest 60 and the armrest support 40 are assembled with each other and fastened into one part. Moreover, the armrest support 40 provides the function of upward and downward/high and low level adjustment of the armrest 60 (as the arrow D in FIG. 41 indicates). Yet the mechanism allowing upward/downward adjustment is already available now and no more details are provided.

Figure 45:
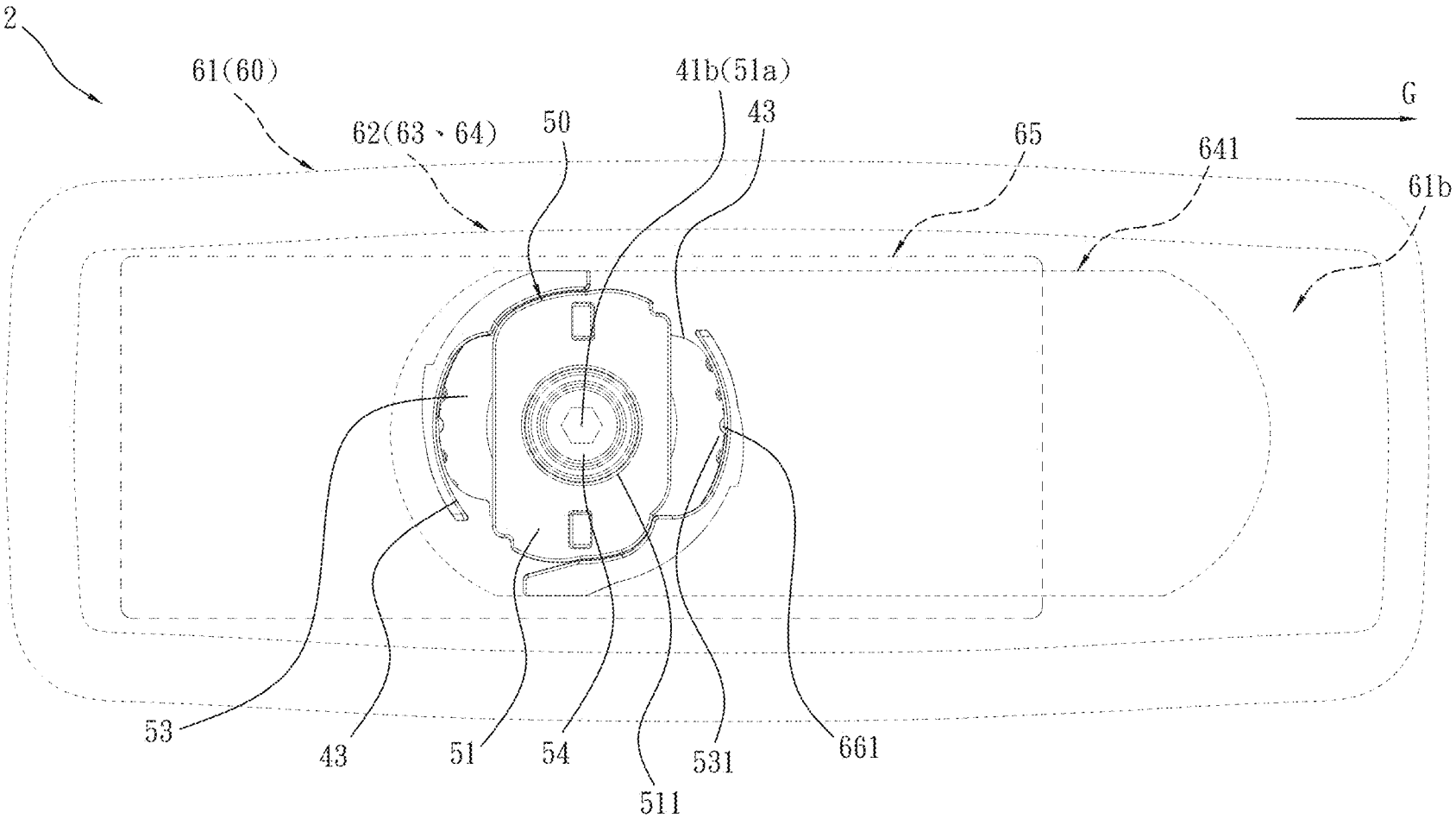
FIG. 45 is a top plan view of the embodiment in FIG. 41 in which an armrest is moved in the lengthwise direction according to the present invention.

Refer to FIG. 45, the armrest body 61 further includes an armrest cover 63, an armrest base 64 with an lengthwise armrest-base hole 641 on a middle part of the bottom surface, and a slide plate 65 whose bottom surface is further connected to the connecting portion 50. The armrest cover 63 and the armrest base 64 are assembled into one assembly with a rectangular space 61*b* formed therein. The slide plate 65 is mounted in the rectangular space 61*b* of the assembly while the lock head 51 of the connecting portion 50 on the slide plate 65 is located in the armrest-base hole 641 and able to be sliding in the armrest-base hole 641 along the lengthwise direction of the armrest-base hole 641. The slide plate 65, the connecting portion 50 and the mounting base 41 are connected into one part and keeping still relative to the armrest support 40 when the lock head 51 and the armrest support 40 are in the second assembled state. The assembly of the armrest cover 63 and the armrest base 64 can be moved relative to the connecting portion 50 and the mounting base 41 in the lengthwise direction (as the arrow B indicates in FIG. 41, and the arrow G indicates in FIG. 45) for adjustment of the position of the armrest 60 lengthways.

Refer to FIG. 39, a vertical step-like cylindrical hole 511 is disposed on a center of the connecting portion 50 and penetrating the connecting portion 50. By a fastener 54 being inserted through the vertical step-like cylindrical hole 511 from top to bottom, the connecting portion 50 is rotatably connected to the bottom surface 611 of the armrest body 61 of the armrest 60.

In the third embodiment shown in FIG. 38, the connecting portion 50 is integrally formed and projecting from the bottom surface 611 of the armrest body 61 of the armrest 60 while the connecting portion 50 of the fourth embodiment shown in FIG. 39 is detachably arranged at the projecting from the bottom surface 611 of the armrest body 61 of the armrest 60. The components of the third and the fourth embodiments shown in the figures and related description with the same reference numerals are considered to be the same components in both embodiment. Moreover, the third and the fourth embodiments have almost the same structure and the differences between the third and the fourth embodiments are described as follows.

Figure 46:
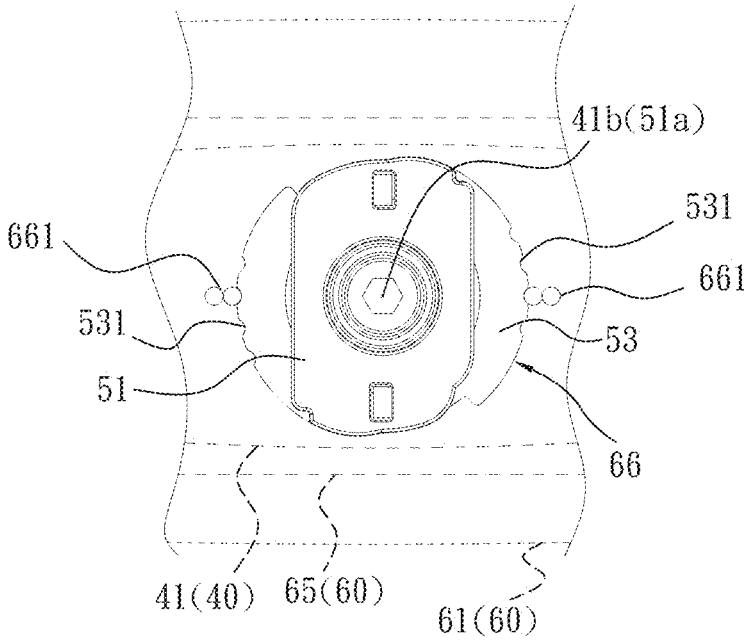
FIG. 46 is a top plan view of an embodiment in which a lock disk of a connecting portion is mounted in a rotary slot according to the present invention.
Figure 47:
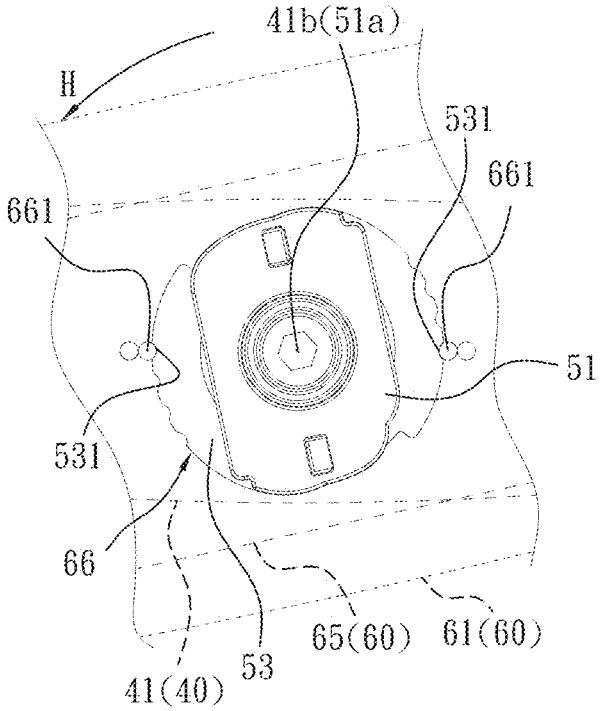
FIG. 47 is a schematic drawing showing the embodiment in FIG. 46 in which an armrest is rotated by a lock disk of a connecting portion in a rotary slot according to the present invention.

As shown in FIG. 39, FIG. 46 and FIG. 47, a lock disk 53 is arranged under the lock neck 52 of the connecting portion 50. A vertical step-like cylindrical hole 511 is disposed on a center of the connecting portion 50 and penetrating the connecting portion 50 while a positioning sleeve 55 is mounted in the vertical step-like cylindrical hole 511. The shape and the area of the horizontal section of the positioning sleeve 55 are corresponding to and smaller than those of the horizontal section of the vertical step-like cylindrical hole 511. By a fastener 54 being inserted through the vertical step-like cylindrical hole 511 and the positioning sleeve 55 from top to bottom, the connecting portion 50 is rotatably connected to the bottom surface 611 of the armrest body 61 of the armrest 60. The bottom surface 611 of the armrest body 61 of the armrest 60 is provided with a rotary slot 66 whose shape and area of the horizontal section thereof are corresponding to and larger than those of the horizontal section of the lock disk 53. The lock disk 53 can be rotated around the positioning sleeve 55 when the connecting portion 50 is connected to the bottom surface 611 of the armrest body 61 of the armrest 60. Thereby the lock disk 53 can also be rotated in the rotary slot 66 of the bottom surface 611 of the armrest body 61 for adjustment and movement at the same time, as the arrow C in FIG. 41 indicates and the arrow H in FIG. 47 indicates. When the lock head 51 and the armrest support 40 are in the second assembled state, the armrest body 61 can be rotated and moved relative to the vertical central axis 41*b* of the mounting base 41 for adjustment of the position by the lock disk 53, as the arrow C in FIG. 41 indicates and the arrow H in FIG. 47 indicates. When the armrest body 61 is rotated and moved for adjustment of the position, the mounting base 41 keeps still while the lock disk 53 in the armrest body 61 is rotated in the rotary slot 66. Thus the connecting portion 50 and the armrest body 61 are rotated and moved relative to the vertical central axis 41*b* of the mounting base 41 for adjustment.

Refer to FIG. 39, FIG. 46 and FIG. 47, the lock disk 53 of the connecting portion 50 is provided with at least one rotary rack 531 with a certain rotation angle. At least one positioning toothed block 661 is disposed on the rotary slot 66 of the armrest body 61 for being engaged with the rotary rack 531 correspondingly. When the armrest body 61 is rotated for adjustment, the armrest body 62 is moved by the rotary rack 531 being rotated an angle θ in the rotary slot 66, as the arrow C in FIG. 41 indicates and the arrow H in FIG. 47 indicates. The angle θ is ranging from 0° to 180°.

The third and the fourth embodiments of the present invention have the same structure as the first and the second embodiments. The lock head of the connecting portion and the lock hole are in a male-female connection and are disposed on the armrest and the armrest support respectively. The embodiments are formed by different combinations of the lock head of the connecting portion and the lock hole with the armrest and the armrest support.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A chair armrest comprising:

an armrest support which includes a top surface with a mounting base arranged at the top surface and having a lengthwise central axis;

a connecting portion which is integrally formed on and projecting from the mounting base of the armrest support and having a lock head with a certain thickness in the vertical direction, and a lock neck which is disposed under and connected to the lock head, and provided with a vertical central axis; and an armrest which includes an armrest pad, and an armrest body which is connected to and enclosed in the armrest pad and composed of a lengthwise central axis, a locking hole disposed on a bottom surface of the armrest body, and a vertical locking slot which is communicating with and arranged at an inner side of the locking hole and having a certain depth;

wherein a shape and an area of a horizontal section of the locking hole are a bit larger than a shape and an area of a horizontal section of the lock head of the connecting portion so that the lock head is able to be vertically mounted into the locking hole and located in the locking slot; wherein a shape and an area of a horizontal section of the locking slot are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot; wherein the lock head is able to be vertically mounted into the locking slot through a lock hole when the lock head of the connecting portion and the lock hole of the armrest body are vertically aligned with each other; wherein there is a staggered angle formed between the lengthwise central axis of the armrest body and the lengthwise central axis of the mounting base when the armrest body and the lock head are in a first assembled state; wherein the lock head is able to be rotated horizontally around the vertical central axis of the lock neck within the locking slot when the armrest body and the lock head are in a first assembled state; wherein the lock head is stopped and positioned at the stopping position of the travel area when the lock head is rotated the staggered angle within the locking slot and the lengthwise central axis of the armrest body and the lengthwise central axis of the mounting base are aligned with each other; the armrest body and the lock head are in a second assembled state while the armrest and the armrest support are assembled and fastened into one part, wherein a set of locking mechanism used in combination with each other is disposed between the lock head and the locking slot so that the lock head can be stopped and positioned at the stopping position of the travel area by the set of locking mechanism after being rotated horizontally along the travel area; thus tightness and strength after assembly of the armrest and the armrest support in the second assembled state is enhanced by the set of locking mechanism, wherein the set of locking mechanism includes at least one locking member extending from a bottom of the locking head and at least one positioning portion disposed on the travel area of the armrest body correspondingly; wherein the locking member is locked into and positioned at the positioning portion correspondingly when the armrest body and the lock head are in the second assembled state.

2. The chair armrest as claimed in claim 1, wherein when the armrest support further includes a long tube, a T-shaped rod and an outer sleeve, the mounting base is integrally formed on a top surface of the T-shaped rod.

3. The chair armrest as claimed in claim 1, wherein when the armrest support further includes a long tube and an outer sleeve but without a T-shaped rod, the mounting base is integrally formed on a top surface of the outer sleeve.

4. The chair armrest as claimed in claim 1, wherein the armrest body further includes an armrest cover, an armrest base with an lengthwise armrest-base hole on a middle of a bottom surface thereof, and a slide plate provided with the locking hole and the locking slot of the armrest body on a top surface thereof; wherein the armrest cover and the armrest base are assembled into one assembly and a rectangular space is formed in the assembly; wherein the slide plate is mounted in the rectangular space of the assembly while the locking hole of the slide plate is mounted into the armrest-base hole and able to be sliding in the armrest-base hole along a lengthwise direction of the armrest-base hole; wherein the slide plate, the connecting portion and the mounting base are connected into one part and the one part is kept still relative to the armrest support after the armrest and the armrest support being in the second assembled state while the assembly of the armrest cover and the armrest base is able to be moved relative to the connecting portion and the mounting base in the lengthwise direction for adjustment of the armrest lengthways.

5. The chair armrest as claimed in claim 4, wherein at least one damping gear is disposed on an edge of the rectangular space of the assembly of the armrest cover and the armrest base; wherein the slide plate is further provided with at least one first rack in the lengthwise direction thereof for being engaged with the damping gear correspondingly; wherein the damping gear is sliding along the first rack of the slide plate so as to make the assembly of the armrest cover and the armrest base move relative to the connecting portion and the mounting base in the lengthwise direction with damping when the assembly of the armrest cover and the armrest base is moved lengthwise relative to the connecting portion and the mounting base.

6. The chair armrest as claimed in claim 4, wherein the armrest pad, the armrest cover, and the armrest base are all provided with an opening formed on one side in the lengthwise direction and openings are communicating with one another for mounting a button therein; a plate part is disposed on an outer end of the button while an elastic member is arranged at an inner end of the button and elastically abutting against a side wall on the opening of the armrest base; a lengthwise connecting slide part is set between the plate part and the elastic member while a projecting handle projecting inward is arranged at an inner side wall of the connecting slide part and a button rack is disposed on the projecting handle; wherein the slide plate is further provided with a second rack which is correspondingly engaged with the button rack; wherein the assembly of the armrest cover and the armrest base is unable to be moved relative to the connecting portion and the mounting base in the lengthwise direction while the button rack being engaged with the second rack of the slide plate; wherein the button rack on the projecting handle of the button is synchronously moved inward to be released from the second rack of the slide plate when the plate part of the button is pressed inward and the assembly of the armrest cover and the armrest base is able to be moved relative to the connecting portion and the mounting base in the lengthwise direction.

7. A chair armrest comprising:

an armrest support which includes a top surface with a mounting base arranged at the top surface and having a lengthwise central axis;

a connecting portion which is integrally formed on and projecting from the mounting base of the armrest support and having a lock head with a certain thickness in the vertical direction, and a lock neck which is disposed under and connected to the lock head, and provided with a vertical central axis; and an armrest which includes an armrest pad, and an armrest body which is connected to and enclosed in the armrest pad and composed of a lengthwise central axis, a locking hole disposed on a bottom surface of the armrest body, and a vertical locking slot which is communicating with and arranged at an inner side of the locking hole and having a certain depth;

wherein a shape and an area of a horizontal section of the locking hole are a bit larger than a shape and an area of a horizontal section of the lock head of the connecting portion so that the lock head is able to be vertically mounted into the locking hole and located in the locking slot wherein a shape and an area of a horizontal section of the locking slot are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot wherein the lock head is able to be vertically mounted into the locking slot through a lock hole when the lock head of the connecting portion and the lock hole of the armrest body are vertically aligned with each other; wherein there is a staggered angle formed between the lengthwise central axis of the armrest body and the lengthwise central axis of the mounting base when the armrest body and the lock head are in a first assembled state; wherein the lock head is able to be rotated horizontally around the vertical central axis of the lock neck within the locking slot when the armrest body and the lock head are in a first assembled state; wherein the lock head is stopped and positioned at the stopping position of the travel area when the lock head is rotated the staggered angle within the locking slot and the lengthwise central axis of the armrest body and the lengthwise central axis of the mounting base are aligned with each other; the armrest body and the lock head are in a second assembled state while the armrest and the armrest support are assembled and fastened into one Part, wherein a set of locking mechanism used in combination with each other is disposed between the lock head and the locking slot so that the lock head can be stopped and positioned at the stopping position of the travel area by the set of locking mechanism after being rotated horizontally along the travel area; thus tightness and strength after assembly of the armrest and the armrest support in the second assembled state is enhanced by the set of locking mechanism, wherein the set of locking mechanism further includes at least one locking-head slot disposed on a vertical edge of the lock head of the connecting portion and at least one elastic locking bump integrally formed on a vertical side wall of the locking slot of the armrest body; wherein the elastic locking bump is able to be locked into and positioned at the locking-head slot correspondingly when the armrest body and the lock head are in the second assembled state so as to improve tightness of the armrest and the armrest support in the second assembled state.

8. An easily assembled chair armrest comprising:

an armrest support which includes a top surface with a mounting base arranged at the top surface and provided with a lengthwise central axis;

a connecting portion which is detachably disposed on and projecting from the mounting base of the armrest support and having a lock head with a certain thickness in the vertical direction, and a lock neck which is disposed under and connected to the lock head, and provided with a vertical central axis; and an armrest which includes an armrest pad, and an armrest body which is connected to and enclosed in the armrest pad;

wherein the armrest body includes a lengthwise central axis, a locking hole disposed on a bottom surface of the armrest body, and a vertical locking slot which is communicating with and arranged at an inner side of the locking hole and having a certain depth; wherein a shape and an area of a horizontal section of the locking hole are a bit larger than a shape and an area of a horizontal section of the lock head of the connecting portion so that the lock head is able to be vertically mounted into the locking hole and located in the locking slot; wherein a shape and an area of a horizontal section of the locking slot are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot; wherein the lock head is able to be vertically mounted into the locking slot through a lock hole when the lock head of the connecting portion and the lock hole of the armrest body are vertically aligned with each other; wherein there is a staggered angle formed between the lengthwise central axis of the armrest body and the lengthwise central axis of the mounting base when the armrest body and the lock head are in a first assembled state; wherein the lock head is able to be rotated horizontally around the vertical central axis of the lock neck within the locking slot when the armrest body and the lock head are in a first assembled state; wherein the lock head is stopped and positioned at the stopping position of the travel area when the lock head is rotated the staggered angle within the locking slot and the lengthwise central axis of the armrest body and the lengthwise central axis of the mounting base are aligned with each other; now the armrest body and the lock head are in a second assembled state while the armrest and the armrest support are assembled and fastened into one part, wherein a set of locking mechanism used in combination with each other is disposed between the lock head and the locking slot so that the lock head can be stopped and positioned at the stopping position of the travel area by the set of locking mechanism after being rotated horizontally along the travel area; thus tightness and strength after assembly of the armrest and the armrest support in the second assembled state is enhanced by the set of locking mechanism, wherein the set of locking mechanism includes at least one locking member extending from a bottom of the locking head and at least one positioning portion disposed on the travel area of the armrest body correspondingly; wherein the locking member is locked into and positioned at the positioning portion correspondingly when the armrest body and the lock head are in the second assembled state.

9. The chair armrest as claimed in claim 8, wherein when the armrest support further includes a long tube, a T-shaped rod and an outer sleeve, the mounting base is integrally formed on a top surface of the T-shaped rod.

10. The chair armrest as claimed in claim 8, wherein when the armrest support further includes a long tube and an outer sleeve but without a T-shaped rod, the mounting base is integrally formed on a top surface of the outer sleeve.

11. The chair armrest as claimed in claim 8, wherein the armrest body further includes an armrest cover, an armrest base with an lengthwise armrest-base hole on a middle of the bottom surface thereof, and a slide plate provided with the locking hole and the locking slot of the armrest body on a top surface thereof; wherein the armrest cover and the armrest base are assembled into one assembly and a rectangular space is formed in the assembly; wherein the slide plate is mounted in the rectangular space of the assembly while the locking hole of the slide plate is mounted into the armrest-base hole and able to be sliding in the armrest-base hole along a lengthwise direction of the armrest-base hole; wherein the slide plate, the connecting portion and the mounting base are connected into one part and the one part is kept still relative to the armrest support after the armrest and the armrest support being in the second assembled state while the assembly of the armrest cover and the armrest base is able to be moved relative to the connecting portion and the mounting base in the lengthwise direction for adjustment of the armrest lengthways.

12. The chair armrest as claimed in claim 11, wherein at least one damping gear is disposed on an edge of the rectangular space of the assembly of the armrest cover and the armrest base; wherein the slide plate is further provided with at least one first rack in the lengthwise direction thereof for being engaged with the damping gear correspondingly; wherein the damping gear is sliding along the first rack of the slide plate so as to make the assembly of the armrest cover and the armrest base move relative to the connecting portion and the mounting base in the lengthwise direction with damping when the assembly of the armrest cover and the armrest base is moved lengthwise relative to the connecting portion and the mounting base.

13. The chair armrest as claimed in claim 11, wherein the armrest pad, the armrest cover, and the armrest base are all provided with an opening formed on one side in the lengthwise direction and openings are communicating with one another for mounting a button therein; a plate part is disposed on an outer end of the button while an elastic member is arranged at an inner end of the button and elastically abutting against a side wall on the opening of the armrest base; a lengthwise connecting slide part is set between the plate part and the elastic member while a projecting handle projecting inward is arranged at an inner side wall of the connecting slide part and a button rack is disposed on the projecting handle; wherein the slide plate is further provided with a second rack which is correspondingly engaged with the button rack; wherein the assembly of the armrest cover and the armrest base is unable to be moved relative to the connecting portion and the mounting base in the lengthwise direction while the button rack being engaged with the second rack of the slide plate; wherein the button rack on the projecting handle of the button is synchronously moved inward to be released from the second rack of the slide plate when the plate part of the button is pressed inward and the assembly of the armrest cover and the armrest base is able to be moved relative to the connecting portion and the mounting base in the lengthwise direction.

14. The chair armrest as claimed in claim 8, wherein a vertical cylindrical hole penetrating the connecting portion is arranged at a center of the connecting portion so that the connecting portion is connected to and fixed on the mounting base by a fastener being inserted through the vertical cylindrical hole from top to bottom.

15. The chair armrest as claimed in claim 8, wherein a lock disk is disposed under the lock neck of the connecting portion; a vertical cylindrical hole is arranged at a center of the connecting portion and penetrating the connecting portion and a positioning sleeve is mounted in the vertical cylindrical hole; shape and area of the horizontal section of the positioning sleeve are corresponding to and smaller than shape and area of the horizontal section of the vertical cylindrical hole; the connecting portion is rotatably connected to the mounting base by a fastener being inserted through the vertical cylindrical hole and the positioning sleeve from top to bottom; wherein a top surface of the mounting base is provided with a rotary slot whose shape and area of the horizontal section are corresponding to and larger than shape and area of the horizontal section of the lock disk; wherein the lock disk is able to be rotated around the positioning sleeve when the connecting portion is connected to the mounting base; the lock disk is also able be moved and adjusted rotationally in the rotary slot of the mounting base; wherein the armrest body is able to be rotationally moved relative to the vertical central axis of the mounting base by the lock disk for position adjustment when the armrest support and the armrest are in the second assembled state; wherein the mounting base keeps still while the lock disk in the armrest body is rotated in the rotary slot of the mounting base to make the connecting portion and the armrest body have rotationally movement and adjustment relative to the vertical central axis of the mounting base when the armrest body is rotated and moved for position adjustment.

16. The chair armrest as claimed in claim 15, wherein the lock disk of the connecting portion is further provided with at least one curved rack having a central angle;

wherein at least one positioning toothed block is disposed on the rotary slot of the mounting base for being engaged with the curved rack correspondingly; wherein the armrest body is able to be rotated a certain angle in the rotary slot by the curved rack while being moved rotationally for adjustment of the position/for position adjustment.

17. A chair armrest comprising:

an armrest support which includes a top surface with a mounting base arranged at the top surface and provided with a lengthwise central axis;

a connecting portion which is detachably disposed on and projecting from the mounting base of the armrest support and having a lock head with a certain thickness in the vertical direction, and a lock neck which is disposed under and connected to the lock head, and provided with a vertical central axis; and an armrest which includes an armrest pad, and an armrest body which is connected to and enclosed in the armrest pad;

wherein the armrest body includes a lengthwise central axis, a locking hole disposed on a bottom surface of the armrest body, and a vertical locking slot which is communicating with and arranged at an inner side of the locking hole and having a certain depth; wherein a shape and an area of a horizontal section of the locking hole are a bit larger than a shape and an area of a horizontal section of the lock head of the connecting portion so that the lock head is able to be vertically mounted into the locking hole and located in the locking slot wherein a shape and an area of a horizontal section of the locking slot are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot wherein the lock head is able to be vertically mounted into the locking slot through a lock hole when the lock head of the connecting portion and the lock hole of the armrest body are vertically aligned with each other; wherein there is a staggered angle formed between the lengthwise central axis of the armrest body and the lengthwise central axis of the mounting base when the armrest body and the lock head are in a first assembled state; wherein the lock head is able to be rotated horizontally around the vertical central axis of the lock neck within the locking slot when the armrest body and the lock head are in a first assembled state; wherein the lock head is stopped and positioned at the stopping position of the travel area when the lock head is rotated the staggered angle within the locking slot and the lengthwise central axis of the armrest body and the lengthwise central axis of the mounting base are aligned with each other; now the armrest body and the lock head are in a second assembled state while the armrest and the armrest support are assembled and fastened into one part, wherein a set of locking mechanism used in combination with each other is disposed between the lock head and the locking slot so that the lock head can be stopped and positioned at the stopping position of the travel area by the set of locking mechanism after being rotated horizontally along the travel area; thus tightness and strength after assembly of the armrest and the armrest support in the second assembled state is enhanced by the set of locking mechanism, wherein the set of locking mechanism further includes at least one locking-head slot disposed on a vertical edge of the lock head of the connecting portion and at least one elastic locking bump integrally formed on a vertical side wall of the locking slot of the armrest body;

wherein the elastic locking bump is able to be locked into and positioned at the locking-head slot correspondingly when the armrest body and the lock head are in the second assembled state so as to improve tightness of the armrest and the armrest support in the second assembled state.

18. An easily assembled chair armrest comprising:

an armrest support which includes a top surface with a mounting base arranged at the top surface and provided with a lengthwise central axis; a locking hole disposed on a top surface of the mounting base and a vertical locking slot communicating with and arranged at an inner side of the locking hole and having a certain depth;

a connecting portion including a lock head with a certain thickness in the vertical direction, and a lock neck which is disposed under and connected to the lock head and having a vertical central axis; and an armrest which includes an armrest pad, and an armrest body which is connected to the armrest pad, enclosed in the armrest pad and having a lengthwise central axis;

wherein the connecting portion is integrally formed on and projecting from the bottom surface of the armrest body of the armrest; wherein a shape and an area of a horizontal section of the locking hole of the armrest support are a bit larger than a shape and an area of a horizontal section of the lock head of the connecting portion so that the lock head is able to be vertically mounted into the locking hole and located in the locking slot; wherein a shape and an area of a horizontal section of the locking slot of the armrest support are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot; wherein the lock head is able to be vertically mounted into the locking slot through a lock hole when the lock head of the connecting portion and the lock hole of the armrest support are vertically aligned with each other; wherein there is a staggered angle formed between the lengthwise central axis of the mounting base and the lengthwise central axis of the armrest body when the lock head and the armrest support are in a first assembled state; wherein the lock head is able to be rotated horizontally around the vertical central axis of the lock neck within the locking slot when the lock head and the armrest support are in the first assembled state; wherein the lock head is stopped and positioned at the stopping position of the travel area when the lock head is rotated the staggered angle within the locking slot and the lengthwise central axis of the mounting base and the lengthwise central axis of the armrest body are coupled with each other; now the lock head and the armrest support are in a second assembled state while the armrest and the armrest support are assembled and fastened into one part, wherein a set of locking mechanism used in combination with each other is disposed between the lock head and the locking slot so that the lock head can be stopped and positioned at the stopping position of the travel area by the set of locking mechanism after being rotated horizontally along the travel area; thus tightness and strength after assembly of the armrest and the armrest support in the second assembled state is enhanced by the set of locking mechanism, wherein the set of locking mechanism includes at least one locking member extending from a bottom of the locking head and at least one positioning portion disposed on the travel area of the armrest body correspondingly; wherein the locking member is locked into and positioned at the positioning portion correspondingly when the armrest body and the lock head are in the second assembled state.

19. The chair armrest as claimed in claim 18, wherein the armrest body further includes an armrest cover, an armrest base with an lengthwise armrest-base hole on a middle part of the bottom surface, and a slide plate whose bottom surface is further connected to the connecting portion; wherein the armrest cover and the armrest base are assembled into one assembly with a rectangular space formed therein; the slide plate is mounted in the rectangular space of the assembly while the lock head of the connecting portion on the slide plate is located in the armrest-base hole and able to be sliding in the armrest-base hole along the lengthwise direction of the armrest-base hole; the slide plate, the connecting portion and the mounting base are connected into one part and keeping still relative to the armrest support when the lock head and the armrest support are in the second assembled state; the assembly of the armrest cover and the armrest base is able to be moved relative to the connecting portion and the mounting base in the lengthwise direction for adjustment of position of the armrest lengthways.

20. An easily assembled chair armrest comprising:

an armrest support which includes a top surface with a mounting base arranged at the top surface and provided with a lengthwise central axis; a locking hole disposed on a top surface of the mounting base and a vertical locking slot communicating with and arranged at the inner side of the locking hole and having a certain depth;

a connecting portion including a lock head with a certain thickness in the vertical direction, and a lock neck which is disposed under and connected to the lock head and having a vertical central axis; and an armrest which includes an armrest pad, and an armrest body which is connected to the armrest pad, enclosed in the armrest pad and having a lengthwise central axis;

wherein the connecting portion is detachably disposed on and projecting from the bottom surface of the armrest body of the armrest; wherein a shape and an area of a horizontal section of the locking hole of the armrest support are a bit larger than a shape and an area of a horizontal section of the lock head of the connecting portion so that the lock head is able to be vertically mounted into the locking hole and located in the locking slot; wherein a shape and an area of a horizontal section of the locking slot of the armrest support are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot; wherein the lock head is able to be vertically mounted into the locking slot through a lock hole when the lock head of the connecting portion and the lock hole of the armrest support are vertically aligned with each other; wherein there is a staggered angle formed between the lengthwise central axis of the mounting base and the lengthwise central axis of the armrest body when the lock head and the armrest support are in a first assembled state; wherein the lock head is able to be rotated horizontally around the vertical central axis of the lock neck within the locking slot when the lock head and the armrest support are in the first assembled state; wherein the lock head is stopped and positioned at the stopping position of the travel area when the lock head is rotated the staggered angle within the locking slot and the lengthwise central axis of the mounting base and the lengthwise central axis of the armrest body are coupled with each other; now the lock head and the armrest support are in a second assembled state while the armrest and the armrest support are assembled and fastened into one part, wherein a lock disk is disposed under the lock neck of the connecting portion; a vertical cylindrical hole is arranged at a center of the connecting portion and penetrating the connecting portion and a positioning sleeve is mounted in the vertical cylindrical hole; shape and area of the horizontal section of the positioning sleeve are corresponding to and smaller than shape and area of the horizontal section of the vertical cylindrical hole; the connecting portion is rotatably connected to the bottom surface of the armrest body of the armrest by a fastener being inserted through the vertical cylindrical hole and the positioning sleeve from top to bottom; wherein the bottom surface of the armrest body of the armrest is provided with a rotary slot whose shape and area of the horizontal section are corresponding to and larger than shape and area of the horizontal section of the lock disk; wherein the lock disk is able to be rotated around the positioning sleeve when the connecting portion is connected to the bottom surface of the armrest body of the armrest the lock disk is also able be moved and adjusted rotationally in the rotary slot of the bottom surface of the armrest body of the armrest wherein the armrest body is able to be rotationally moved relative to the vertical central axis of the mounting base by the lock disk for position adjustment when the lock head and the armrest support are in the second assembled state; wherein the mounting base keeps still while the lock disk in the armrest body is rotated in the rotary slot of the mounting base to make the connecting portion and the armrest body have rotationally movement and adjustment relative to the vertical central axis of the mounting base when the armrest body is rotated and moved for position adjustment.

21. The chair armrest as claimed in claim 20, wherein the armrest body further includes an armrest cover, an armrest base with an lengthwise armrest-base hole on a middle part of the bottom surface, and a slide plate whose bottom surface is further connected to the connecting portion; wherein the armrest cover and the armrest base are assembled into one assembly with a rectangular space formed therein; the slide plate is mounted in the rectangular space of the assembly while the lock head of the connecting portion on the slide plate is located in the armrest-base hole and able to be sliding in the armrest-base hole along the lengthwise direction of the armrest-base hole; the slide plate, the connecting portion and the mounting base are connected into one part and keeping still relative to the armrest support when the lock head and the armrest support are in the second assembled state; the assembly of the armrest cover and the armrest base is able to be moved relative to the connecting portion and the mounting base in the lengthwise direction for adjustment of position of the armrest lengthways.

22. The chair armrest as claimed in claim 20, wherein a vertical cylindrical hole penetrating the connecting portion is arranged at a center of the connecting portion so that the connecting portion is connected to and fixed on the bottom surface of the armrest body of the armrest by a fastener being inserted through the vertical cylindrical hole from top to bottom.

23. The chair armrest as claimed in claim 20, wherein the lock disk of the connecting portion is further provided with at least one curved rack having a central angle; wherein at least one positioning toothed block is disposed on the rotary slot of the armrest body for being engaged with the curved rack correspondingly; wherein the armrest body is able to be rotated a certain angle in the rotary slot by the curved rack while being moved rotationally for adjustment of the position.

24. An easily assembled chair armrest comprising:

an armrest support which includes a top surface with a mounting base arranged at the top surface and provided with a lengthwise central axis; a locking hole disposed on a top surface of the mounting base and a vertical locking slot communicating with and arranged at an inner side of the locking hole and having a certain depth;

a connecting portion including a lock head with a certain thickness in the vertical direction, and a lock neck which is disposed under and connected to the lock head and having a vertical central axis; and an armrest which includes an armrest pad, and an armrest body which is connected to the armrest pad, enclosed in the armrest pad and having a lengthwise central axis;

wherein the connecting portion is integrally formed on and projecting from the bottom surface of the armrest body of the armrest; wherein a shape and an area of a horizontal section of the locking hole of the armrest support are a bit larger than a shape and an area of a horizontal section of the lock head of the connecting portion so that the lock head is able to be vertically mounted into the locking hole and located in the locking slot; wherein a shape and an area of a horizontal section of the locking slot of the armrest support are larger than the shape and the area of the horizontal section of the lock head of the connecting portion so that the locking slot includes at least one travel area; thus the lock head is able to be rotated horizontally along the travel area and then stopped and positioned at a stopping position of the travel area after being vertically mounted into the locking slot; wherein the lock head is able to be vertically mounted into the locking slot through a lock hole when the lock head of the connecting portion and the lock hole of the armrest support are vertically aligned with each other; wherein there is a staggered angle formed between the lengthwise central axis of the mounting base and the lengthwise central axis of the armrest body when the lock head and the armrest support are in a first assembled state; wherein the lock head is able to be rotated horizontally around the vertical central axis of the lock neck within the locking slot when the lock head and the armrest support are in the first assembled state; wherein the lock head is stopped and positioned at the stopping position of the travel area when the lock head is rotated the staggered angle within the locking slot and the lengthwise central axis of the mounting base and the lengthwise central axis of the armrest body are coupled with each other; now the lock head and the armrest support are in a second assembled state while the armrest and the armrest support are assembled and fastened into one part, wherein a set of locking mechanism used in combination with each other is disposed between the lock head and the locking slot so that the lock head can be stopped and positioned at the stopping position of the travel area by the set of locking mechanism after being rotated horizontally along the travel area; thus tightness and strength after assembly of the armrest and the armrest support in the second assembled state is enhanced by the set of locking mechanism, wherein the set of locking mechanism further includes at least one locking-head slot disposed on a vertical edge of the lock head of the connecting portion and at least one elastic locking bump integrally formed on a vertical side wall of the locking slot of the armrest body;

wherein the elastic locking bump is able to be locked into and positioned at the locking-head slot correspondingly when the armrest body and the lock head are in the second assembled state so as to improve tightness of the armrest and the armrest support in the second assembled state.

* * * * *